US010584008B2

(12) United States Patent
Matsuda et al.

(10) Patent No.: US 10,584,008 B2
(45) Date of Patent: Mar. 10, 2020

(54) SHEET CONVEYING DEVICE AND IMAGE FORMING APPARATUS INCORPORATING THE SHEET CONVEYING DEVICE

(71) Applicants: Hiromichi Matsuda, Kanagawa (JP); Katsuaki Miyawaki, Kanagawa (JP); Jun Yamane, Kanagawa (JP); Hideyuki Takayama, Kanagawa (JP)

(72) Inventors: Hiromichi Matsuda, Kanagawa (JP); Katsuaki Miyawaki, Kanagawa (JP); Jun Yamane, Kanagawa (JP); Hideyuki Takayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/000,042

(22) Filed: Jun. 5, 2018

(65) Prior Publication Data

US 2018/0362278 A1 Dec. 20, 2018

(30) Foreign Application Priority Data

Jun. 15, 2017 (JP) ..... 2017-117546
Apr. 24, 2018 (JP) ..... 2018-082822

(51) Int. Cl.
*B65H 9/00* (2006.01)
*B65H 7/06* (2006.01)
(Continued)

(52) U.S. Cl.
CPC ..... *B65H 9/002* (2013.01); *B65H 5/062* (2013.01); *B65H 7/06* (2013.01); *B65H 7/14* (2013.01);
(Continued)

(58) Field of Classification Search
CPC ..... B65H 9/002; B65H 9/106
(Continued)

(56) References Cited

U.S. PATENT DOCUMENTS

2005/0035536 A1 2/2005 Suga et al.
2010/0209162 A1 8/2010 Ferrara et al.
(Continued)

FOREIGN PATENT DOCUMENTS

JP 6-234441 8/1994
JP 9-175694 7/1997
(Continued)

OTHER PUBLICATIONS

Extended European Search Report dated Nov. 19, 2018 by the European Patent Office for European Patent Application No. 18175803.8.

*Primary Examiner* — Thomas A Morrison
(74) *Attorney, Agent, or Firm* — Harness, Dickey & Pierce P.L.C.

(57) ABSTRACT

A sheet conveying device, which is included in an image forming apparatus, includes a detector to detect a lateral end face of a sheet, a first pair of rollers to hold and convey the sheet and swing in a direction parallel to a plane of the sheet, a second pair of rollers to convey the sheet together with the first pair of rollers, and a controller to rotate the first pair of rollers to multiple angles, detect time changes at each angle at the lateral end face while conveying the sheet, and determine a home position corresponding to a position where respective rates of the time changes of the sheet at the first and second nip regions are substantially identical to each other or a home position having a least difference of rates of the time changes of the sheet at the first and second nip regions.

21 Claims, 15 Drawing Sheets

(51) Int. Cl.
*B65H 9/10* (2006.01)
*B65H 5/06* (2006.01)
*B65H 7/14* (2006.01)

(52) U.S. Cl.
CPC ..... *B65H 9/103* (2013.01); *B65H 2404/1424* (2013.01); *B65H 2404/14212* (2013.01); *B65H 2557/61* (2013.01)

(58) Field of Classification Search
USPC ..... 271/226–228
See application file for complete search history.

(56) References Cited

U.S. PATENT DOCUMENTS

| | | | | |
|---|---|---|---|---|
| 2014/0193186 | A1* | 7/2014 | Furuyama | G03G 15/657 399/388 |
| 2016/0159598 | A1* | 6/2016 | Yamane | B65H 9/002 271/227 |

FOREIGN PATENT DOCUMENTS

| | | |
|---|---|---|
| JP | 10-067448 | 3/1998 |
| JP | 10-120253 | 5/1998 |
| JP | 2005-041603 | 2/2005 |
| JP | 2005-041604 | 2/2005 |
| JP | 2005-053646 | 3/2005 |
| JP | 2005-178929 | 7/2005 |
| JP | 2006-027859 | 2/2006 |
| JP | 2007-022806 | 2/2007 |
| JP | 2011-098790 | 5/2011 |
| JP | 2014-088263 | 5/2014 |
| JP | 2014-193769 | 10/2014 |
| JP | 2016-024546 | 2/2016 |
| JP | 2016-044067 | 4/2016 |
| JP | 2016-175776 | 10/2016 |
| JP | 2016-188142 | 11/2016 |
| JP | 2017-202916 | 11/2017 |

* cited by examiner

SHEET CONVEYING DEVICE AND IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2017-117546, filed on Jun. 15, 2017, and 2018-082822, filed on Apr. 24, 2018, in the Japan Patent Office, the entire disclosure of each of which is hereby incorporated by reference herein.

BACKGROUND

Technical Field

This disclosure relates to a sheet conveying device that conveys a sheet, and an image forming apparatus such as a copier, printer, facsimile machine, a multi-functional apparatus including at least two functions of the copier, printer, and facsimile machine, and an offset printing machine.

Related Art

Known image forming apparatuses such as copiers and printers employ a sheet conveying device. Such a known sheet conveying device employs a technique in which an amount of angular displacement of a sheet being conveyed in a predetermined sheet conveying direction (i.e., a direction displaced in a radial direction or a rotational direction to the sheet conveying direction within a sheet conveying plane) is detected, and the angular displacement of the sheet is corrected based on the detection result.

To be specific, the above-described known sheet conveying device includes a pair of sheet holding rollers that is movable in the radial or rotational direction of the sheet. Further, the known sheet conveying device also includes multiple contact image sensors (CISs) to detect respective positions in the width direction of the sheet being conveyed in the predetermined direction. The multiple CISs are aligned and spaced apart along the sheet conveying direction. When the sheet passes the respective positions of the CISs, the CISs detect the amount of angular displacement of the sheet, and a pair of sheet holding rollers are caused to move from home positions to face the sheet according to the amount of angular displacement. While the sheet that has reached the pair of sheet holding rollers is being held and conveyed by the pair of sheet holding rollers, the pair of sheet holding rollers is rotated to return to the home position. By so doing, the angular displacement of the sheet is corrected.

However, due to errors in assembly and various parts such as a pair of sheet holding rollers, the above-described known sheet conveying device is likely that the home position of the pair of sheet holding rollers is out of a target position, and therefore likely to fail to perform correction of angular displacement of a sheet by a pair of sheet holding rollers with high accuracy.

SUMMARY

At least one aspect of this disclosure provides a sheet conveying device including a detector, a first drive device, a second drive device, a first pair of rollers, a second pair of rollers, and a controller. The detector is configured to detect a position of a lateral end face of a sheet conveyed in a sheet conveyance passage. The first pair of rollers has a first nip region, is driven by the first drive device and rotated by the second drive device, and is configured to convey the sheet while holding the sheet at the first nip region and swing in a direction parallel to a plane of the sheet. The second pair of rollers has a second nip region and disposed either one of an upstream side and a downstream side of the sheet conveyance passage in a sheet conveying direction from the first pair of rollers, and is configured to convey the sheet while holding the sheet at the second nip region, together with the first pair of rollers. The controller is configured to cause the second drive device to rotate the first pair of rollers to multiple angles in the direction parallel to the plane of the sheet, cause the detector to detect time change at each of the multiple angles at the lateral end face of the sheet while conveying the sheet by the first pair of rollers and the second pair of rollers, and determine a home position corresponding to a position where a rate of the time change after the sheet has reached the first nip region of the first pair of rollers is substantially identical to a rate of the time change after the sheet has reached the second nip region of the second pair of rollers.

Further, at least one aspect of this disclosure provides an image forming apparatus including the above-described sheet conveying device.

At least one aspect of this disclosure provides a sheet conveying device including a detector, a first drive device, a second drive device, a first pair of rollers, a second pair of rollers, and a controller. The detector is configured to detect a position of a lateral end face of a sheet conveyed in a sheet conveyance passage. The first pair of rollers has having a first nip region, is driven by the first drive device and rotated by the second drive device, and is configured to convey the sheet while holding the sheet at the first nip region and swing in a direction parallel to a plane of the sheet. The second pair of rollers has a second nip region and disposed either one of an upstream side and a downstream side of the sheet conveyance passage in a sheet conveying direction from the first pair of rollers, and is configured to convey the sheet while holding the sheet at the second nip region, together with the first pair of rollers. The controller is configured to cause the second drive device to rotate the first pair of rollers to multiple angles in the direction parallel to the plane of the sheet, cause the detector to detect time change at each of the multiple angles at the lateral end face of the sheet while conveying the sheet by the first pair of rollers and the second pair of rollers, and determine a home position corresponding to a position having a least difference of rates between the time change after the sheet has reached the first nip region of the first pair of rollers and the time change after the sheet has reached the second nip region of the second pair of rollers.

Further, at least one aspect of this disclosure provides an image forming apparatus including the above-described sheet conveying device.

BRIEF DESCRIPTION OF THE SEVERAL VIEWS OF THE DRAWINGS

An exemplary embodiment of this disclosure will be described in detail based on the following figured, wherein.

Figure 1:
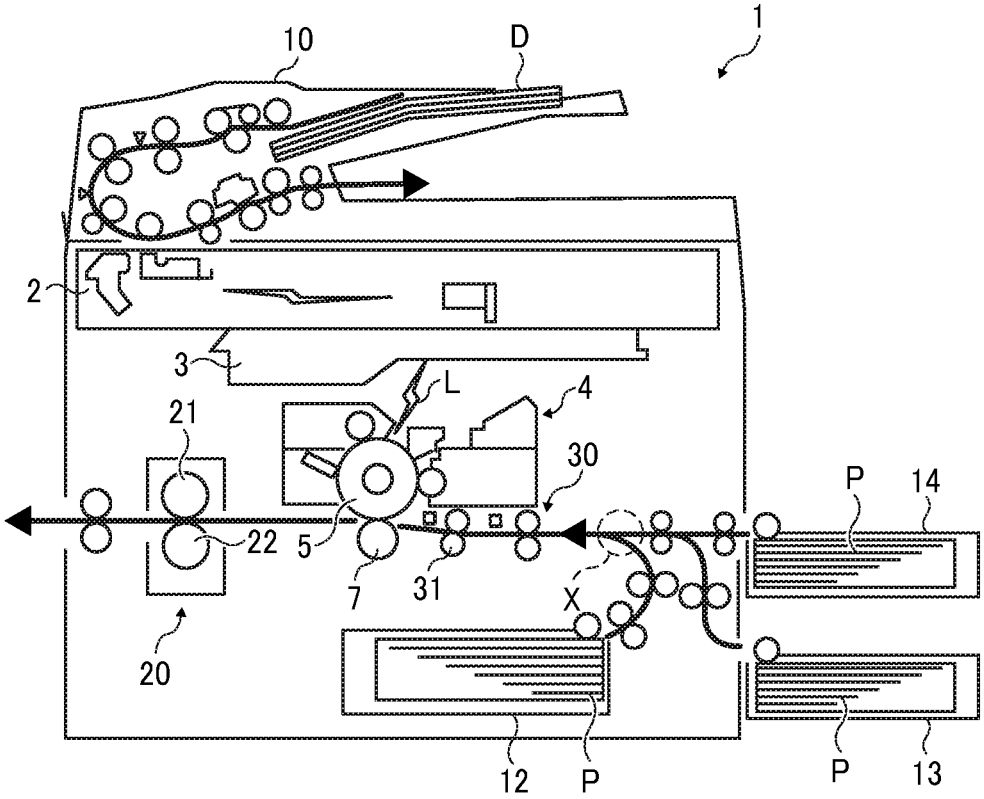
FIG. 1 is a diagram illustrating an overall configuration of an image forming apparatus according to Embodiment 1 of this disclosure.

The accompanying drawings are intended to depict embodiments of this disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Next, a description is given of a configuration and functions of an image forming apparatus according to an embodiment of this disclosure, with reference to drawings. It is to be noted that identical elements (for example, mechanical parts and components) are provided identical reference numerals and redundant descriptions are summarized or omitted accordingly.

Embodiment 1

Now, a description is given of an overall configuration and operations of an image forming apparatus 1 according to an embodiment of this disclosure, with reference to FIG. 1. FIG. 1 is a diagram illustrating a schematic configuration of the image forming apparatus 1 according to Embodiment 1 of this disclosure.

The image forming apparatus 1 may be a copier, a facsimile machine, and a printer. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the image forming apparatus 1 includes a document reading device 2, an exposure device 3, an image forming device 4, a photoconductor drum 5, a transfer roller 7, a document conveying unit 10, a first sheet feeding unit 12, a second sheet feeding unit 13, a third sheet feeding unit 14, a fixing device 20, a fixing roller 21, a pressure roller 22, a sheet conveying device 30, and a pair of sheet holding rollers 31.

The document reading device 2 optically reads image data of an original document D.

The exposure device 3 emits an exposure light L based on the image data read by the document reading device 2 to irradiate the exposure light L onto a surface of the photoconductor drum 5 that functions as an image bearer.

The image forming device 4 forms a toner image on the surface of the photoconductor drum 5.

The transfer roller 7 functions as a transfer unit to transfer the toner image formed on the surface of the photoconductor drum 5 onto a sheet P.

The photoconductor drum 5 that functions as an image bearer and the transfer roller 7 that functions as a transfer unit are included in the image forming device 4.

The document conveying unit 10 conveys the original document D set on a document tray or loader to the document reading device 2.

The first sheet feeding unit 12, the second sheet feeding unit 13, and the third sheet feeding unit 14 are sheet trays, each of which contains the sheet P (a recording medium P) therein.

The fixing device 20 includes the fixing roller 21 and the pressure roller 22 to fix an unfixed image formed on the sheet P to the sheet P by application of heat by the fixing roller 21 and pressure by the pressure roller 22.

The sheet conveying device 30 conveys the sheet P through a sheet conveyance passage.

The pair of sheet holding rollers 31 functions as a pair of rotary bodies (e.g., a pair of registration rollers and a pair of timing rollers) to convey the sheet P to the transfer roller 7. The pair of sheet holding rollers 31 is also referred to as a pair of angular and lateral displacement correction rollers.

Now, a description is given of regular image forming operations performed by the image forming apparatus 1, with reference to FIG. 1.

The original document D is fed from a document loading table provided to the document conveying unit 10 and conveyed by multiple pairs of sheet conveying rollers disposed in the document conveying unit 10 in a direction indicated by arrow in FIG. 1 over the document reading device 2. At this time, the document reading device 2 optically reads image data of the original document D passing over the document reading device 2.

Consequently, the image data optically scanned by the document reading device 2 is converted to electrical signals. The converted electrical signals are transmitted to the exposure device 3 (a writing portion) by which the image is optically written. Then, the exposure device 3 emits the exposure light (laser light) L based on the image data of the electrical signals toward the surface of the photoconductor drum 5 of the image forming device 4.

By contrast, the photoconductor drum 5 of the image forming device 4 rotates in a clockwise direction in FIG. 1. After a series of predetermined image forming processes, e.g., a charging process, an exposing process, and a developing process is completed, a toner image corresponding to the image data is formed on the surface of the photoconductor drum 5.

Then, the image formed on the photoconductor drum 5 is transferred onto the sheet P that has been conveyed by the pair of sheet holding rollers 31 (i.e., a first pair of rollers) that functions as a pair of registration rollers, at the transfer roller 7.

By contrast, referring to FIGS. 1 and 2, the sheet P to be conveyed to the transfer roller 7 (the image forming part) is operated as follows.

Figure 2:
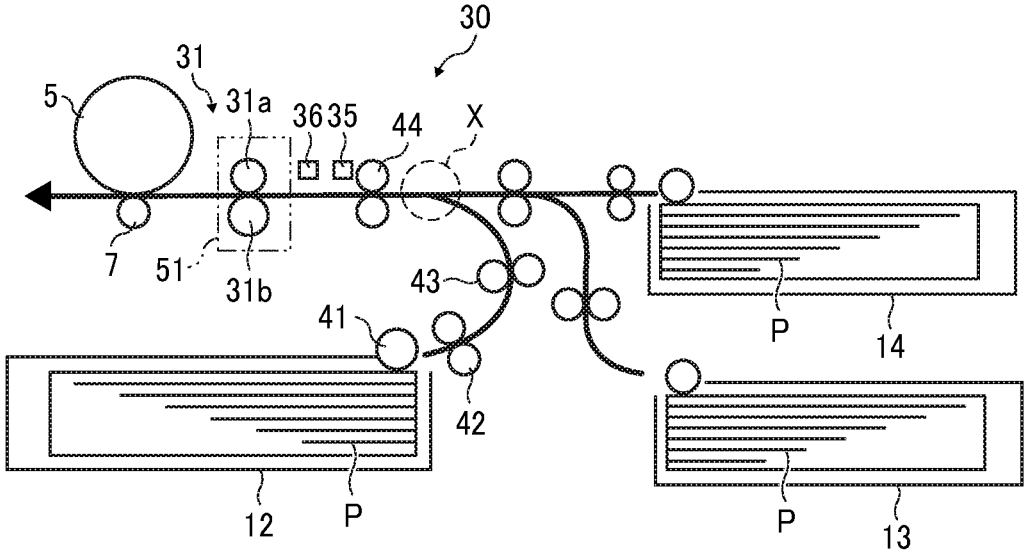
FIG. 2 is a schematic diagram illustrating a sheet conveying device included in the image forming apparatus of FIG. 1.

First, as illustrated in FIGS. 1 and 2, one of the first sheet feeding unit 12, the second sheet feeding unit 13 and the third sheet feeding unit 14 of the image forming apparatus 1 is selected automatically or manually. It is to be noted that the first sheet feeding unit 12, the second sheet feeding unit 13 and the third sheet feeding unit 14 basically have an identical configuration to each other, except the second sheet feeding unit 13 and the third sheet feeding unit 14 disposed outside an apparatus body of the image forming apparatus 1. The following description is given of an operation in a case when the first sheet feeding unit 12 disposed inside the apparatus body of the image forming apparatus 1 is selected.

Consequently, when the first sheet feeding unit 12 of the image forming apparatus 1 is selected, an uppermost sheet P contained in the first sheet feeding unit 12 is fed by a sheet feed roller 41 toward a curved sheet conveyance passage having a first pair of sheet conveying rollers 42 and a second pair of sheet conveying rollers 43.

The sheet P travels in the curved sheet conveying passage toward a merging point X where the sheet conveying passage of the sheet P fed from the first sheet feeding unit 12 and respective sheet conveying passages of the sheet P fed from the second sheet feeding unit 13 and the third sheet feeding unit 14 disposed outside an apparatus body of the image forming apparatus 1 merge. After passing the merging point X, the sheet P passes a straight sheet conveying passage in which a third pair of sheet conveying rollers 44 (i.e., a pair of upstream side sheet conveying rollers) and an alignment unit 51 that includes and corresponds to the pair of sheet holding rollers 31 are disposed, and reaches the alignment unit 51. Then, the pair of sheet holding rollers 31, which is provided to the alignment unit 51, performs the correction of angular displacement of the sheet P and the correction of lateral displacement of the sheet P. The sheet P is then conveyed toward the transfer roller 7 (i.e., a transfer nip region where the transfer roller 7 and the photoconductor drum 5 contact to each other) in synchronization with movement of the toner image formed on the surface of the photoconductor drum 5 for positioning. The transfer roller 7 and the photoconductor drum 5 rotate along with the sheet conveying direction indicated by arrow in FIG. 1. Both the transfer roller 7 and the photoconductor drum 5 are disposed downstream from the pair of sheet holding rollers 31 in the sheet conveying direction, so as to also function as a second pair of rollers (a pair of downstream side sheet conveying rollers) to convey the sheet P at the nip region (i.e., the transfer nip region) while holding the sheet P together with the pair of sheet holding rollers 31 (i.e., the first pair of rollers).

After completion of the transferring process, the sheet P passes the location of the transfer roller 7 (the transfer nip region), and then reaches the fixing device 20 via the sheet conveyance passage. In the fixing device 20, the sheet P is inserted into a fixing nip region formed between the fixing roller 21 and the pressure roller 22, so that the toner image is fixed to the sheet P by application of heat applied by the fixing roller 21 and pressure applied by the fixing roller 21 and the pressure roller 22. After having been discharged from the fixing nip region formed between the fixing roller 21 and the pressure roller 22 of the fixing device 20, the sheet P having the toner image fixed thereto is ejected from an apparatus body of the image forming apparatus 1 onto a sheet ejection tray.

Accordingly, a series of image forming processes is completed.

As illustrated in FIG. 2, the image forming apparatus 1 according to Embodiment 1 of this disclosure feeds the sheet P from any selected one of the first sheet feeding unit 12, the second sheet feeding unit 13, and the third sheet feeding unit 14 toward the transfer roller 7 (i.e., an image forming area on the sheet P).

Further, each of multiple pairs of conveying rollers including the first pair of sheet conveying rollers 42, the second pair of sheet conveying rollers 43, the third pair of sheet conveying rollers 44 provided to the sheet conveying device 30 (including other pairs of sheet conveying rollers without reference numerals) includes a driving roller and a driven roller as a pair. The driving roller is driven and rotated by a driving mechanism and a driven roller is rotated with the driving roller by a frictional resistance with the driving roller. According to this configuration, the sheet P is conveyed while being held between these two rollers.

As described above, the image forming apparatus 1 includes a straight sheet conveyance passage extending substantially linearly along the sheet conveying direction of sheet P. The straight sheet conveyance passage is a sheet conveyance passage from the merging point X, where a branched sheet conveyance passage from the first sheet feeding unit 12 and the other branched sheet conveyance passages from the second sheet feeding unit 13 and the third sheet feeding unit 14 merge, to the transfer roller 7 (i.e., the transfer nip region). The straight conveying guide plates hold both sides (i.e., the front side and the back side) of the sheet P therebetween while the sheet P is being conveyed. Two contact image sensors (hereinafter, a contact image sensor is referred to as a CIS) that are position detectors to detect the sheet P at respective positions are disposed along the sheet conveying direction. Specifically, the third pair of sheet conveying rollers 44 (i.e., the pair of upstream side sheet conveying rollers), a first CIS 35, a second CIS 36 and the pair of sheet holding rollers 31 (i.e., the alignment unit 51) are disposed in this order to a downstream side in the sheet conveying direction. Both the third pair of sheet conveying rollers 44 and the pair of sheet holding rollers 31 are pair rollers, each pair including a drive roller and a driven roller. The drive roller and the driven roller of each of the third pair of sheet conveying rollers 44 and the pair of sheet holding rollers 31 convey the sheet P while holding the sheet P in a nip region formed therebetween. The pair of sheet holding rollers 31 is included in and also acts as the alignment unit 51 to align positional deviation, that is, to perform the correction of angular displacement of the sheet P (i.e., the correction of a positional deviation of the sheet P in the direction of rotation of the pair of sheet holding rollers 31 on a plane parallel to the sheet P to be conveyed in the sheet conveying direction) and the correction of lateral displacement of the sheet P (i.e., the correction of a positional deviation of the sheet P in the width direction). Details of the operations of the pair of sheet holding rollers 31 (i.e., the alignment unit 51) will be described below.

Next, a detailed description is given of the sheet conveying device 30 according to Embodiment 1 of this disclosure, with reference to FIGS. 2 through 10.

Specifically, a configuration, functions, and operations of the sheet conveying device 30 from the merging point X to the transfer roller 7 (i.e., an image forming area) are described.

Figure 3:
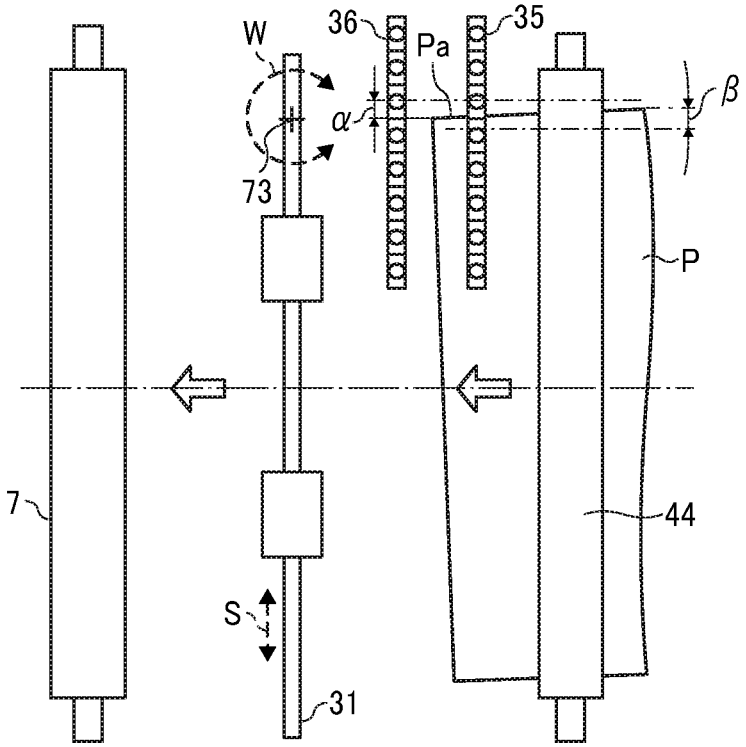
FIG. 3 is a top view illustrating part of the sheet conveying device of FIG. 2.

As illustrated in FIGS. 2 and 3, the sheet conveying device 30 includes a third pair of sheet conveying rollers 44 that functions as a pair of upstream side sheet conveying rollers, a first CIS 35, a second CIS 36, and the pair of sheet holding rollers 31 that functions as the alignment unit 51, a pair of registration rollers and a pair of lateral and angular displacement correction rollers, along the straight sheet conveyance passage (extending from the merging point X to the transfer roller 7) of the sheet P.

Here, the pair of sheet holding rollers 31 that functions as a first pair of rollers is driven and rotated by a first drive motor 61 to convey the sheet P while the pair of sheet holding rollers 31 is holding the sheet P at the nip region. The pair of sheet holding rollers 31 is also rotated by a second drive device including a second drive motor 63, a lever 81, a cam follower 82, a roller 83, a first cam 84 and a timing belt 98 in a direction parallel to a plane of the sheet P. Hereinafter, the direction parallel to a plane of the sheet P is occasionally referred to as an "angular direction."

The pair of sheet holding rollers 31 includes multiple roller pairs that are divided in the width direction of the sheet P. In this specification, the multiple roller pairs of the pair of sheet holding rollers 31 are simply referred to in a singular form as a "pair of sheet holding rollers" or a "pair of sheet holding rollers 31" collectively. Specifically, the pair of sheet holding rollers 31 includes a drive roller 31*b* and a driven roller 31*a*. The drive roller 31*b* is driven to rotate by the first drive motor 61 (see FIG. 4) that functions as a first drive device. The driven roller 31*a* is rotated together with the drive roller 31*b*. A nip region is formed between the drive roller 31*b* and the driven roller 31*a* to hold and convey the sheet P. That is, the pair of sheet holding rollers 31 conveys the sheet P by rotating while holding the sheet P between the drive roller 31*b* and the driven roller 31*a*.

It is to be noted that, the pair of sheet holding rollers 31 in Embodiment 1 has rollers divided in the width direction thereof. However, the structure of a pair of sheet holding rollers is not limited thereto. For example, a pair of sheet holding rollers that is not divided in the width direction but extends over the whole width thereof can be applied to this disclosure.

In addition, the pair of sheet holding rollers 31 is formed to rotate about a support shaft 73 in an angular direction of the sheet P (i.e., a direction indicated by a dotted arrow W in FIG. 3) together with a holding member 72 that functions as a holding member and to move in a width direction of the sheet P (i.e., a direction indicated by a dotted arrow S in FIG. 3).

The pair of sheet holding rollers 31 performs correction of lateral registration of the sheet P by moving along a guide 71*a*, together with the holding member 72, based on the detection result of the first CIS 35 (or the second CIS 36) that functions as a detector (a first detector). At the same time, the pair of sheet holding rollers 31 performs correction of angular displacement of the sheet P by rotating about the support shaft 73, together with the holding member 72, based on the detection results of the first CIS 35 and the second CIS 36, both also functioning as a second detector.

Figure 4:
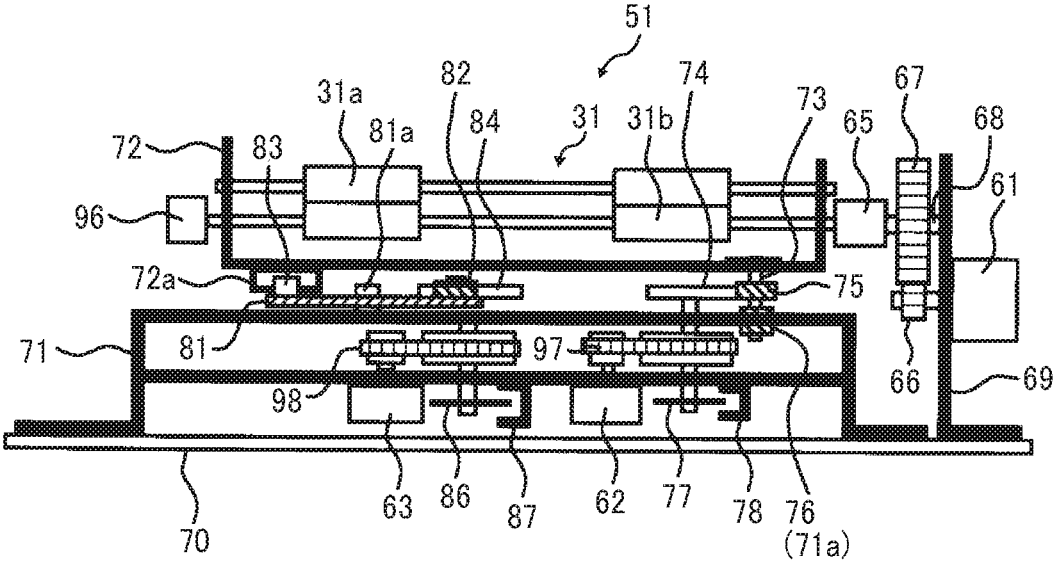
FIG. 4 is a diagram illustrating a main part of the sheet conveying device.
Figure 5:
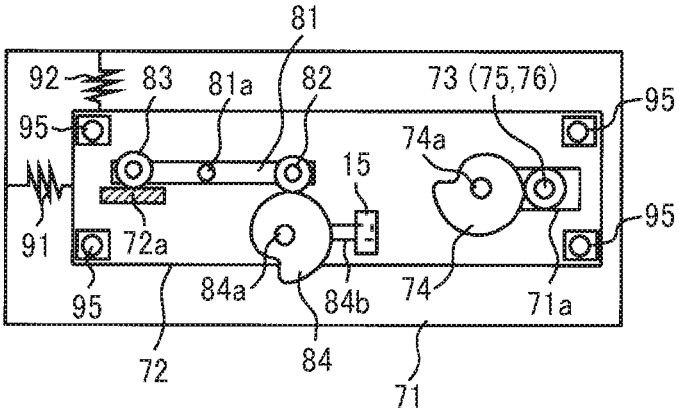
FIG. 5 is a top view illustrating the main part of the sheet conveying device.
Figure 6:
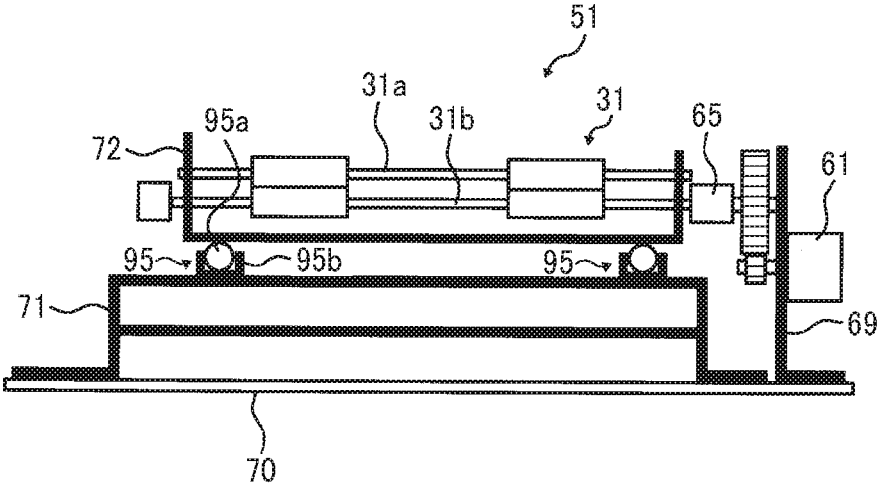
FIG. 6 is a diagram illustrating the sheet conveying device in which a holding member is supported on a frame by a relay support.

More specifically, as illustrated in FIGS. 4 through 6, the pair of sheet holding rollers 31 (specifically, the drive roller 31*b* and the driven roller 31*a*) is rotatably supported by the holding member 72 that functions as a holding member. The holding member 72 is a substantially box shaped metal plate and has openings formed at both ends in the width direction (i.e., the vertical direction to the drawing sheet of FIG. 2 and the left and right directions of FIGS. 4, 5 and 6). Shafts of the drive roller 31*b* and the driven roller 31*a* of the pair of sheet holding rollers 31 are inserted into the respective openings of the holding member 72, via respective bearings. The holding member 72 moves together with the pair of sheet holding rollers 31. Specifically, the holding member 72 and the pair of sheet holding rollers 31 move together in the width direction of a body frame 70 and of a base frame 71 and pivot about the support shaft 73 of the holding member 72.

A body frame 70, a base frame 71 and a bracket 69 are relatively fixed by screw to form a frame of the sheet conveying device 30. The first drive device that includes the first drive motor 61 and a gear train including gears 66 and 67 is fixed to the bracket 69 and is coupled to one lateral end (i.e., one end in the width direction) of the drive roller 31*b* of the pair of sheet holding rollers 31, via a two-step spline coupling 65. The first drive device transmits a rotation driving force of the first drive motor 61 that is fixed to the frames including the bracket 69, the body frame 70 and the base frame 71 of the sheet conveying device 30, to the drive roller 31*b* via the gear train of the gears 66 and 67 and the two-step spline coupling 65, so as to drive and rotate the pair of sheet holding rollers 31.

An encoder 96 that controls a rotation speed and a rotation timing of the pair of sheet holding rollers 31 (including the drive roller 31*b*) is mounted on an opposed end in the width direction (or an opposed lateral end) of the drive roller 31*b*.

Figure 7:
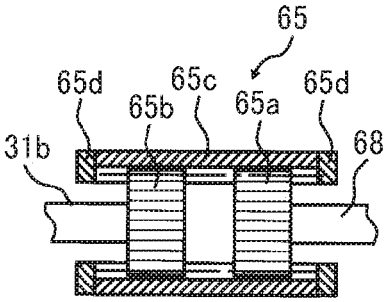
FIG. 7 is a diagram illustrating a configuration of a two step spline coupling.

As illustrated in FIG. 7, the two-step spline coupling 65 includes a first spline gear 65*a*, a second spline gear 65*b*, an intermediate spline gear 65*c* and guide rings 65*d*.

The first spline gear 65*a* is an external gear and is mounted on a rotary shaft 68 that rotates together with the gear 67 of the gear train (including the gears 66 and 67) of the first drive device. The rotary shaft 68 is rotatably held by the bracket 69 via a bearing.

The second spline gear 65*b* is an external gear and is to a rotary shaft of the drive roller 31*b* of the pair of sheet holding rollers 31.

The intermediate spline gear 65*c* is an internal gear and is extended in the width direction so that the intermediate spline gear 65*c* meshes with two spline gears 65*a* and 65*b* even when the pair of sheet holding rollers 31 (attached to the holding member 72) shifts (slides) in the width direction.

Each of the two spline gears 65*a* and 65*b* has a crown shape so that the two spline gears 65*a* and 65*b* mesh with the intermediate spline gear 65*c* even when the pair of sheet holding rollers 31 (attached to the holding member 72) rotates in a direction of rotation of the sheet P. By employing the above-described two-step spline coupling 65, even when the pair of sheet holding rollers 31 rotates about the support shaft 73 in a substantially horizontal direction or slidably moves in the width direction, the first drive motor 61 (of the first drive device) that is fixedly disposed to the bracket 69, the body frame 70 and the base frame 71 applies a driving force accurately to the drive roller 31*b* reliably, and the pair of sheet holding rollers 31 is rotates preferably.

Each of the guide rings 65*d* is a stopper having a substantially ring shape. The guide rings 65*d* are mounted at both ends of the intermediate spline gear 65*c* in the width direction, so as to prevent the two spline gears 65*a* and 65*b* from moving relatively in the width direction and resulting in falling from the two-step spline coupling 65.

As illustrated in FIGS. 5 and 6, the holding member 72 that functions as a holding member is movably supported by the frames, i.e., the bracket 69, the body frame 70 and the base frame 71, via free bearings 95 (ball transfers). Each of the free bearings 95 functions as a relay support. According to this configuration, the holding member 72 is movable in any directions in the width direction of the sheet P and the direction of rotation of the sheet P, relative to the bracket (frames) 69 through 71 (specifically, the base frame 71). In other words, the holding member 72 is supported to be movable on a plane perpendicular to the drawing sheet of FIG. 6. It is to be noted that the free bearings 95 are hidden in FIG. 4, so as to clearly view the other parts and components.

Each of the free bearings 95 (the ball transfer) is known to include a steel ball 95*a* (sphere) inserted into a recess portion of a base 95*b*. The top end of the steel ball 95*a* contacts a base surface of the holding member 72 as a point contact. The free bearings 95 that function as a relay support are provided to support the holding member 72 at three points or more, with respect to the bracket 69, the body frame 70 and the base frame 71. (In Embodiment 1, four free bearings 95 are mounted.) In Embodiment 1, as illustrated in FIG. 5, the free bearings 95 are fixed to the base frame 71 at respective positions of four corners on the base surface of the holding member 72 (i.e., respective positions at which the free bearings 95 can contact the holding member 72 even when the holding member 72 moves or rotates by the maximum movable distance).

By supporting the holding member 72 to the base frame 71 via the free bearings 95, even when the holding member 72 moves relative to the base frame 71 in a surface direction, a friction load generated due to the movement of the holding member 72 can be reduced to the minimum (least) amount, and therefore correction of position of the sheet P (i.e., correction of angular displacement and correction of lateral displacement of the sheet P) can be performed with high responsiveness and high accuracy.

Here, referring to FIGS. 4 and 5, the support shaft 73 (a stud) is mounted on the holding member 72 (the holding member). The support shaft 73 (the stud) is engaged or fitted to the guide 71*a* that extends in the width direction of the base frame 71 (i.e., the body frame 70).

Specifically, the support shaft 73 (the stud) is fixed by caulking on the base surface of the holding member 72, at a position relatively close to the end of the drive side (at the right side of FIGS. 4 and 5), so that the support shaft 73 projects downwardly. By contrast, the guide 71*a* that functions as a substantially rectangular opening is formed in the ceiling of the base frame 71, at the position relatively close to the end of the drive side (at the right side of FIGS. 4 and 5). As illustrated in FIGS. 4 and 5, the support shaft 73 is inserted into the guide 71*a* (the opening) of the base frame 71 via a guide roller 76 that is rotatably attached to the support shaft 73. The holding member 72 and the pair of sheet holding rollers 31 slide together in the width direction of the sheet P along with movement of the support shaft 73 along the guide 71*a* or rotate together about the support shaft 73.

It is to be noted that, in Embodiment 1, the guide 71*a* to which the support shaft 73 of the holding member 72 is engaged or fitted is a substantially rectangular opening. However, the structure of the guide 71*a* is not limited thereto as long as the guide 71*a* causes the holding member 72 to move as described above. For example, the guide 71*a* may be a slot or a groove.

The pair of sheet holding rollers 31 further includes the second drive device that includes the second drive motor 63, the lever 81, the cam follower 82, the roller 83, the first cam 84 and the timing belt 98. The second drive device is disposed to the base frame 71 (the body frame 70). According to the above-described configuration, by rotating the holding member 72 about the support shaft 73 based on the detection results of the two CISs, which are the first CIS 35 and the second CIS 36 and form the second detector, the pair of sheet holding rollers 31 is rotated in the angular direction together with the holding member 72.

The pair of sheet holding rollers 31 further includes a third drive device that includes a third drive motor 62, a second cam 74 and a timing belt 97. The third drive device is disposed to the base frame 71 (the body frame 70). The third drive device moves the support shaft 73 along the guide 71*a* based on the detection results of the first CIS 35 (or the second CIS 36) that functions as a detector. By so doing, the pair of sheet holding rollers 31 is shift in the width direction together with the holding member 72.

To be more specific, the second drive device is to rotate the holding member 72 (the pair of sheet holding rollers 31) about the support shaft 73. The second drive device includes the second drive motor 63, the timing belt 98, the first cam 84, a first tension spring 92 that functions as a first biasing body and the lever 81 (the rotation lever).

The first tension spring 92 that functions as a first biasing body is connected to the holding member 72 and the base frame 71 so as to bias the holding member 72 in a normal angular direction (i.e., a clockwise direction about the support shaft 73 in FIG. 5).

The first cam 84 is held by the base frame 71 and is rotatable about a rotary support shaft 84*a*. The first cam 84 indirectly presses and moves the holding member 72, which is biased in the normal angular direction by the first tension spring 92, in an opposite direction to the angular direction (i.e., a counterclockwise direction about the support shaft 73 in FIG. 5) via the lever 81. That is, the second drive device is configured to press and move the holding member 72 via the lever 81.

The lever 81 is held by the base frame 71 and rotatable about a rotary support shaft 81*a*. A cam follower 82 is rotatably mounted on (axially supported by) one end of the lever 81. The cam follower 82 that functions as a first rotary member contacts the first cam 84. A roller 83 is rotatably mounted on (axially supported by) the other end of the lever 81. The roller 83 that functions as a second rotary member contacts a projection 72*a* of the holding member 72.

The second drive motor 63 is fixed to the base frame 71. The timing belt 98 is wound around a drive pulley mounted on a motor shaft of the second drive motor 63 and a driven pulley mounted on the rotary support shaft 84*a* of the first cam 84.

Figure 8A:
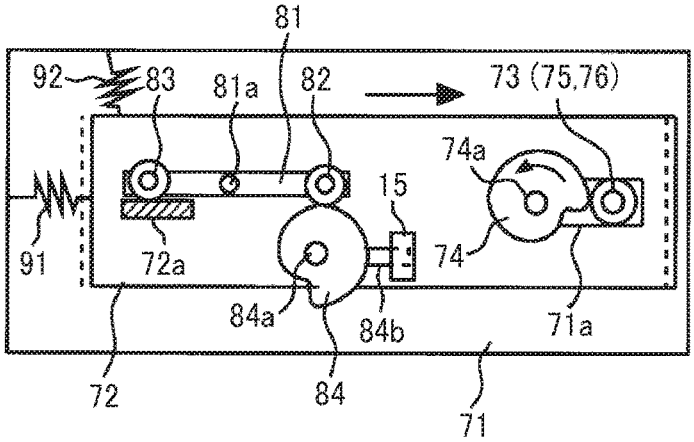
FIG. 8A is a diagram illustrating the holding member moving in a width direction.
Figure 8B:
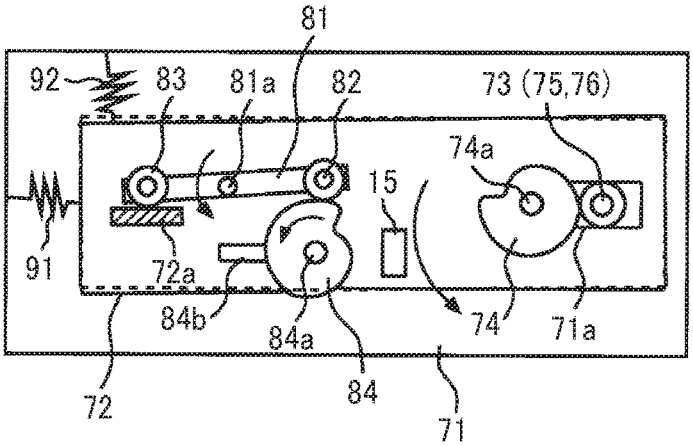
FIG. 8B is a diagram illustrating the holding member swinging in an angular direction.

According to this configuration, as the second drive motor 63 starts, the rotation driving force generated by the second drive motor 63 is transmitted to the first cam 84 via the timing belt 98, so that the first cam 84 rotates in the counterclockwise direction, as illustrated in FIG. 8B. Due to the rotation force of the first cam 84, the lever 81 is pressed to rotate about the rotary support shaft 81*a*. Consequently, the holding member 72 is pressed by the lever 81 at the position where the projection 72*a* is formed, and therefore the holding member 72 rotates against the spring force of the first tension spring 92.

It is to be noted that the first cam 84 and the lever 81 (the cam follower 82) constantly in contact with each other by the act of the spring force of the first tension spring 92. Further, the holding member 72 (the projection 72*a*) and the lever 81 (the roller 83) constantly in contact with each other. An angle of rotation of the holding member 72 that rotates about the support shaft 73 (i.e., an attitude of the holding member 72 in the direction of rotation) is determined based on an angle of rotation of the first cam 84 (i.e., an attitude of the first cam 84 in the direction of rotation).

As described above, the pair of sheet holding rollers 31 includes the cam follower 82 that functions as a first rotary member disposed at a contact position where the first cam 84 and the lever 81 contact with each other, and the roller 83 that functions as a second rotary member disposed at a contact position where the holding member 72 (the projection 72*a*) and the lever 81 contact with each other. With this configuration, a friction load generated at each of the contact positions can be extremely reduced, and therefore the correction of angular displacement (skew correction) of the sheet P can be performed with high responsiveness and high accuracy.

Further, in Embodiment 1, an encoder wheel 86 is mounted on the rotary support shaft 84*a* of the first cam 84 and an encoder sensor 87 is fixedly disposed on the base frame 71 at a position opposing the encoder wheel 86, as illustrated in FIG. 4. Then, the second drive motor 63 is controlled based on a detection result of the encoder wheel 86 obtained by the encoder sensor 87, and the angle of rotation of the first cam 84 (the holding member 72) is adjusted. Consequently, the correction of angular displacement of the sheet P is performed.

The first cam 84 is manufactured to generate a motion curve having a constant velocity. According to this structure, the angle of rotation of the first cam 84 is controlled to have an amount of change in proportion to the angle of rotation of the holding member 72. Therefore, the correction of angular displacement of the sheet P is performed with high accuracy.

Here, in Embodiment 1, as illustrated in FIGS. 5, 8A, 8B and 8C, in order to grasp an angular home position in the angular (rotational) direction (i.e., a home position in the rotational direction) of the pair of sheet holding rollers 31, the first cam 84 includes a feeler 84*b* that is disposed at a position not to interfere or hinder the contact of the first cam 84 and the lever 81). Further, a photosensor 15 is fixed to the base frame 71 to optically detect presence or absence of the feeler 84*b*.

Figure 8C:
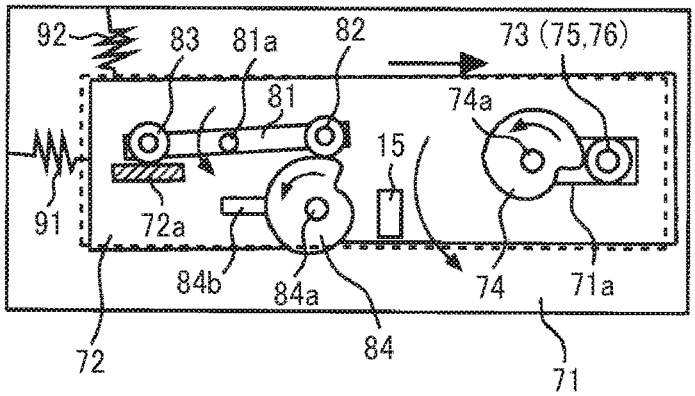
FIG. 8C is a diagram illustrating the holding member moving in the width direction and the angular direction at the same time.

To be more specific, as illustrated in FIGS. 5 and 8A, in a state in which the feeler 84*b* of the first cam 84 is detected by the photosensor 15, a controller 90 (see FIG. 16) determines that the pair of sheet holding rollers 31 is located at the angular home position (a first home position). By contrast, as illustrated in FIGS. 8B and 8C, in a state in which the feeler 84*b* of the first cam 84 is not detected by the photosensor 15, the controller 90 determines that the pair of sheet holding rollers 31 is not located at the angular home position (a first home position). Consequently, in a case in which the pair of sheet holding rollers 31 is rotated from the home position and then is returned to the home position, the second drive motor 63 is driven until the feeler 84*b* of the first cam 84 is detected by the photosensor 15.

It is to be noted that a detailed description of adjustment of the home position (a first home position) of the pair of sheet holding rollers 31 is given below.

By contrast, the third drive device is to move the holding member 72 (the pair of sheet holding rollers 31) in the width direction together with the support shaft 73 that moves along the guide 71*a*. The third drive device includes the third drive motor 62, the timing belt 97, the second cam 74, and a second tension spring 91 that functions as a second biasing body.

The second tension spring 91 that functions as a first biasing body is connected to the holding member 72 and the base frame 71 so as to bias the holding member 72 in a normal width direction (i.e., the left direction in FIG. 5).

The second cam 74 is held by the base frame 71 to be rotatable about the rotary support shaft 74*a*, so that the second cam 74 presses the holding member 72 that is biased by the second tension spring 91 toward the normal width direction of the sheet P, in an opposite direction of the normal width direction of the sheet P (i.e., the right direction in FIG. 5). A cam follower 75 is mounted on (axially supported by) the support shaft 73 of the holding member 72, at a position at which the cam follower 75 contacts the second cam 74. The guide roller 76 (a rotary member) is mounted (axially supported) at a position at which the support shaft 73 contacts the guide 71*a* (the base frame 71).

The third drive motor 62 is fixed to the base frame 71. The timing belt 97 is wound around a drive pulley mounted on the motor shaft of the third drive motor 62 and a driven pulley mounted on the rotary support shaft 74*a* of the second cam 74.

According to this configuration, as the third drive motor 62 starts, the rotation driving force generated by the third drive motor 62 is transmitted to the second cam 74 via the timing belt 97, so that the second cam 74 causes the holding member 72 to slide (move) against the spring force of the second tension spring 91, as illustrated in FIG. 8A.

It is to be noted that the second cam 74 and the support shaft 73 (the cam follower 75) are constantly in contact with each other due to the spring force of the second tension spring 91. Further, a distance of movement of (the support shaft 73 of) the holding member 72 (a position in the width direction of the sheet P) is determined based on an angle of rotation of the second cam 74 (i.e., an attitude of the second cam 74 in the direction of rotation).

As described above, the pair of sheet holding rollers 31 includes the second cam 74 and the support shaft 73 in contact with each other via the cam follower 75. With this configuration, a friction load generated at the contact position can be extremely reduced, and therefore the correction of lateral displacement of the sheet P can be performed with high responsiveness and high accuracy.

Further, in Embodiment 1, as illustrated in FIG. 4, an encoder wheel 77 is mounted on the rotary support shaft 74*a* of the second cam 74 and an encoder sensor 78 is fixedly disposed on the base frame 71 at a position opposing the encoder wheel 77. Then, in response to the detection of the encoder wheel 77 by the encoder sensor 78, the third drive motor 62 controls to adjust the angle of rotation (i.e., the attitude in the rotation angle) of the second cam 74. Consequently, the holding member 72 is slid to correct the angular displacement of the sheet P.

The second cam 74 is manufactured to generate a motion curve having a constant velocity. According to this structure, the angle of rotation of the second cam 74 is controlled to have an amount of change in proportion to the distance of movement of the holding member 72. Therefore, the correction of lateral displacement of the sheet P is performed with high accuracy.

FIG. 8C is a diagram illustrating an example of movement of the holding member 72 when the angular displacement of the sheet P and the lateral displacement of the sheet P are corrected simultaneously.

As illustrated in FIG. 8C, as the second drive motor 63 starts and the first cam 84 is rotated, the lever 81 is pressed by the first cam 84 to rotate about the rotary support shaft 81*a*. Then, the holding member 72 is pressed by the lever 81 at the position of the projection 72*a*, so that the holding member 72 rotates against the spring force of the first tension spring 92. At the same time, as the third drive motor 62 starts, the second cam 74 is rotated. Due to the rotation of the second cam 74, the holding member 72 slides against the spring force of the second tension spring 91. At this time, the roller 83 of the lever 81 presses the projection 72*a* (of the holding member 72) while moving on the surface of the projection 72*a*.

As described above, in Embodiment 1, the support shaft 73 that functions as a rotational support that is fixed to the holding member 72 that rotatably holds the pair of sheet holding rollers 31 is caused to slide. Therefore, a single holder frame (i.e., the holding member 72) can perform a rotational operation and a shift operation (a slide operation). Consequently, the second drive device that performs the rotational operation of the pair of sheet holding rollers 31 and the third drive device that performs the shift operation of the pair of sheet holding rollers 31 are mounted on a frame (i.e., the base frame 71) that is fixed to the apparatus body of the image forming apparatus 1, instead of mounting on the holding member 72. According to this configuration, the weight of the framework to perform the rotational operation and the shift (slide) operation is reduced, so as to enhance the responsiveness of the rotational operation and the shift operation. At the same time, the power of the drive source (i.e., the second drive motor 63) of the second drive device and the drive source (i.e., the third drive motor 62) of the third drive device are reduced. Accordingly, a reduction in size and cost of the sheet conveying device 30 can be achieved. Further, in Embodiment 1, the first drive device that drives and rotates the pair of sheet holding rollers 31 is mounted on the frame (i.e., the bracket 69) of the sheet conveying device 30, not on the holding member 72. Therefore, the above-described effect is achieved more reliably.

Further, since the support shaft 73 is caused to shift by the second cam 74, the support shaft 73 has one contact point with the holding member 72 that is a moving target. Therefore, even when the support shaft 73 is being rotated, the support shaft 73 can smoothly move along the guide 71*a* while sliding on the one contact point on the surface of the second cam 74. Further, the first cam 84 is in contact with the lever 81 that is a rotation target at one contact point. Therefore, even if the holding member 72 is shifted, the lever 81 (the holding member 72) can smoothly shift and rotate while sliding on the one contact point on the surface of the first cam 84.

Then, while holding and conveying the sheet P, the pair of sheet holding rollers 31 corrects the amount of the angular displacement of the sheet P based on the detection results of the two CISs, that is, the first CIS 35 and the second CIS 36. That is, the pair of sheet holding rollers 31 functions as a member to perform correction of angular displacement (correction of rotational deviation) of the sheet P by changing the direction of conveyance of the sheet P in the sheet conveyance passage.

Further, while holding and conveying the sheet P, the pair of sheet holding rollers 31 corrects the lateral displacement amount based on at least one of the detection results of the two CISs, that is, the first CIS 35 and the second CIS 36. That is, the pair of sheet holding rollers 31 functions as a member to perform correction of lateral displacement of the sheet P by changing the width direction of conveyance of the sheet P in the sheet conveyance passage.

Here, the third pair of sheet conveying rollers 44 functions as a pair of upstream side sheet conveying rollers that is disposed upstream from the pair of sheet holding rollers 31 in the sheet conveying direction (i.e., at the upstream side of the sheet conveying direction). The third pair of sheet conveying rollers 44 is a pair of sheet conveying rollers that conveys the sheet P by rotating while holding the sheet P and that has the rollers separatable from each other to switch between a sheet holding state and a non sheet holding state. After the sheet P has reached and contacted the pair of sheet holding rollers 31 to be conveyed while being held by the pair of sheet holding rollers 31. In this state, the third pair of sheet conveying rollers 44 that is holding the sheet P releases the sheet P to be switched from the sheet holding state to the non sheet holding state.

In Embodiment 1, the pair of sheet holding rollers 31 also functions as a pair of registration rollers that is disposed upstream from the transfer roller 7 that functions as a pair of downstream side sheet conveying rollers in the sheet conveyance passage in the sheet conveying direction. By rotating the pair of sheet holding rollers 31 while holding the sheet P, the pair of sheet holding rollers 31 conveys the sheet P (i.e., the sheet P after the pair of sheet holding rollers 31 has corrected the angular displacement and the lateral displacement) toward the transfer roller 7 (i.e., the pair of downstream side sheet conveying rollers).

Here, the first drive motor 61 that drives and rotates (the drive roller 31*b* of) the pair of sheet holding rollers 31 is a drive motor with variable number of rotations to change a speed of conveyance of the sheet P. Then, when a sheet detecting sensor that is a photosensor detects the timing of arrival of the sheet P at the pair of sheet holding rollers 31, that is, when a state in which the sheet P contacts the nip region of the pair of sheet holding rollers 31 and the pair of sheet holding rollers 31 holds the sheet P is detected), the pair of sheet holding rollers 31 performs a desired lateral displacement correction and a desired angular displacement correction, and the speed of conveyance of the sheet P by the pair of sheet holding rollers 31 is changed based on the detection result (that is, the timing of arrival of the sheet P at the pair of sheet holding rollers 31) of the sheet detecting sensor. Specifically, in order to synchronize the timing at which the pair of sheet holding rollers 31 conveys the sheet P to the transfer roller 7 and the timing at which the toner image formed on the surface of the photoconductor drum 5 reaches the transfer roller 7, the speed of conveyance of the sheet P conveyed by the pair of sheet holding rollers 31 is varied, that is, the timing to convey the sheet P toward the image forming area is adjusted. By so doing, the pair of sheet holding rollers 31 can correct the lateral displacement of the sheet P and the angular displacement without stopping the conveyance of the sheet P and transfer the toner image onto the sheet P at a desired position.

It is to be noted that, immediately after the leading end of the sheet P has reached the image forming area (i.e., the transfer nip region), the speed of conveyance of the sheet P conveyed by the pair of sheet holding rollers 31 is adjusted, so as not to cause a linear velocity difference with the photoconductor drum 5 to result in distortion of the toner image to be transferred onto the sheet P, in other words, the speed of conveyance of the sheet P is adjusted to cause the linear velocity difference with the photoconductor drum 5 to be 1.

As illustrated in FIG. 3, two CISs, that is, the first CIS 35 and the second CIS 36, function as a detector and are disposed upstream from the pair of sheet holding rollers 31 and downstream from the third pair of sheet conveying rollers 44 in the sheet conveyance passage in the sheet conveying direction. Specifically, the first CIS 35 and the second CIS 36 are multiple photosensors (each including a light emitting element such as a light receiving diode, LED, and a light receiving element such as a photo diode) aligned equally spaced apart in the width direction of the sheet P. The first CIS 35 and the second CIS 36 detect respective positions of a lateral end face Pa of the sheet P, that is, an edge portion of one end side. Consequently, in Embodiment 1, at least one of the first CIS 35 and the second CIS 36 is used to detect a lateral displacement amount of the sheet P. That is, the first CIS 35 and the second CIS 36 detect the displacement in the width direction of the sheet P to be conveyed in the sheet conveyance passage of the sheet conveying device 30. Then, the pair of sheet holding rollers 31 performs the correction of lateral displacement of the sheet P based on the detection results obtained by the first CIS 35 and the second CIS 36.

It is to be noted that, in Embodiment 1, as illustrated in FIG. 3, the second CIS 36 is disposed on one lateral end side of the sheet P to detect the position of the lateral end face Pa of the sheet P. However, the structure of the second CIS 36 is not limited thereto. For example, the second CIS 36 may be disposed extending over the entire width direction of the sheet P to detect both lateral end faces of the sheet P (or the entire length in the width direction of the sheet P).

Then, based on the detection result of the first CIS 35 and the second CIS 36, the pair of sheet holding rollers 31 (together with the holding member 72) moves in the width direction of the sheet P while holding and conveying the sheet P, so that a positional deviation in the width direction (i.e., the lateral displacement) of the sheet P to be conveyed in the sheet conveyance passage is corrected.

For example, with reference to FIG. 3, when the first CIS 35 and the second CIS 36 detect a state in which the sheet P is displaced to one end side in the width direction (toward the lower side in FIG. 3) by a distance $\alpha$ relative to a lateral home position in the width direction indicated by a dotted line (that is, a position of the sheet P without any displacement in the width direction, which is also a second home position), the controller 90 determines the distance $\alpha$, in other words, the amount of lateral displacement, as a lateral displacement correction amount, and causes the pair of sheet holding rollers 31 (together with the holding member 72) to move by the distance $\alpha$ (in other words, by an amount same as the amount of lateral displacement of the sheet P) toward an opposite side in the width direction (toward the upper side in FIG. 3) before the pair of sheet holding rollers 31 holds and conveys the sheet P (i.e., the shift control is performed). Then, when the pair of sheet holding rollers 31 holds and conveys the sheet P, the pair of sheet holding rollers 31 is moved to the second home position.

That is, before the sheet P is conveyed to the pair of sheet holding rollers 31, the third drive device causes the pair of sheet holding rollers 31 to move in the width direction from the second home position according to the lateral displacement of the sheet P, based on the detection results of the first CIS 35 and the second CIS 36 (each functioning as a detector). Then, the third drive device causes the pair of sheet holding rollers 31 while holding the sheet P to move to the second home position so as to correct the lateral displacement of the sheet P.

The two CISs, that is, the first CIS 35 and the second CIS 36 functions as a second detector to detect an angular displacement amount (a positional deviation in the rotational direction) of the sheet P to be conveyed in the sheet conveyance passage in the sheet conveying direction.

Specifically, as described above, the first CIS 35 and the second CIS 36 are disposed upstream from the pair of sheet holding rollers 31 in the sheet conveying direction and aligned at positions spaced apart from each other in the sheet conveying direction. Then, an angular displacement amount $\beta$ of the sheet P is determined based on the amounts of displacement of the end face Pa of the sheet P respectively detected by the first CIS 35 and the second CIS 36 and a distance between the first CIS 35 and the second CIS 36. Consequently, in Embodiment 1 of this disclosure, the pair of sheet holding rollers 31 performs the angular displacement correction based on results detected by the first CIS 35 and the second CIS 36, while the sheet P is being held and conveyed by the pair of sheet holding rollers 31.

As an example, with reference to FIG. 3, when the first CIS 35 and the second CIS 36 detect a state in which the sheet P is displaced by an angle $\beta$ to a normal direction (a normal angular displacement) relative to the angular home position indicated by a dotted line (that is, a normal position of the sheet without any displacement in the rotational direction), the controller 90 (see FIG. 16) determines the angular displacement amount $\beta$ as a correction amount and causes the pair of sheet holding rollers 31 (together with the holding member 72) to swing by the angle $\beta$ (in other words, by an amount same as the amount of angular displacement of the sheet P) toward an opposite side (i.e., the opposite direction of the rotational direction of the pair of sheet holding rollers 31, which is also in the clockwise direction in FIG. 3) from the home position (i.e., the first home position) before the pair of sheet holding rollers 31 holds and conveys the sheet P. Then, when the pair of sheet holding rollers 31 holds and conveys the sheet P, the pair of sheet holding rollers 31 is rotated to the first home position.

That is, before the sheet P is conveyed to the pair of sheet holding rollers 31, the second drive device causes the pair of sheet holding rollers 31 to rotate from the home position (i.e., the first home position) according to the angular displacement of the sheet P, based on the detection results of the first CIS 35 and the second CIS 36, so that the pair of sheet holding rollers 31 is brought to face the sheet P. Then, the second drive device causes the pair of sheet holding rollers 31 while holding the sheet P to rotate to the home position (i.e., the first home position) so as to correct the angular displacement of the sheet P.

As described above, in Embodiment 1, by causing the pair of sheet holding rollers 31 to rotate in the angular direction based on the detection results of the first CIS 35 and the second CIS 36 while the pair of sheet holding rollers 31 is holding and conveying the sheet P without stopping the conveyance of the sheet P, the angular displacement amount is corrected. And, at the same time, by causing the pair of sheet holding rollers 31 to move in the width direction of the sheet P, the lateral displacement amount of the sheet P is corrected.

By so doing, when compared with a configuration in which the angular displacement correction and the lateral displacement correction are performed while stopping conveyance of the sheet P, the pair of sheet holding rollers 31 can enhance the productivity of a sheet conveying device and an image forming apparatus significantly. Further, when the angular displacement amount and the lateral displacement amount are corrected, a linear velocity difference is not caused between multiple rollers separated apart in the width direction of the pair of sheet holding rollers 31. Therefore, even when a sheet P such as a thin paper or a sheet having a low coefficient of friction on the surface is conveyed, the sheet P is not warped or slipped.

Now, a description is given of an example of operations of the sheet conveying device 30 having the above-described configuration, with reference to FIGS. 9A through 9F and 10A through 10D.

It is to be noted that FIGS. 9A, 9C, 9E, 10A and 10C are top views illustrating operations of the sheet conveying device 30 in this order and that FIGS. 9B, 9D, 9F, 10B and 10D are side views illustrating the operations of the sheet conveying device 30 corresponding to FIGS. 9A, 9C, 9E, 10A and 10C, respectively.

Figure 9A:
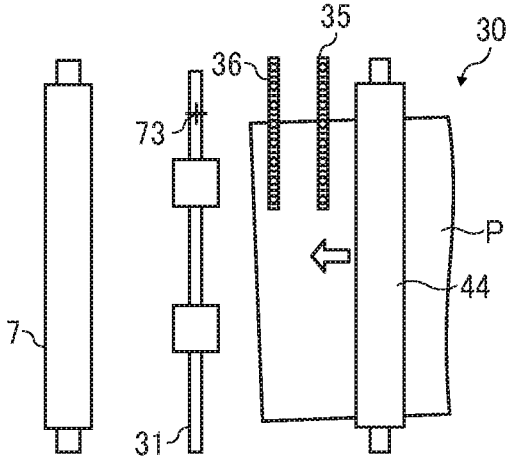
FIGS. 9A, 9B, 9C, 9D, 9E and 9F are diagrams illustrating operations performed by the sheet conveying device.
Figure 9B:
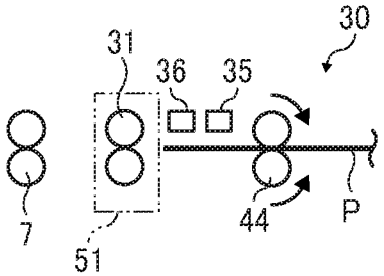

First, as illustrated in FIGS. 9A and 9B, the sheet P fed from the first sheet feeding unit 12 is held and conveyed by the third pair of sheet conveying rollers 44 toward the pair of sheet holding rollers 31 in a direction indicated by white arrow. At this time, the position of the pair of sheet holding rollers 31 in the rotation direction is located in the first home position, which is a normal position corresponding to the sheet P that has no angular displacement, and the position thereof in the width direction is located in the second home position, which is a normal position corresponding to the sheet P that has no lateral displacement.

Then, when the sheet P reaches the first CIS 35 and the second CIS 36, the first CIS 35 and the second CIS 36 detect the lateral displacement amount α of the sheet P. To be more specific, in Embodiment 1, the lateral displacement amount α of the sheet P is detected based on a mean value of the lateral displacement amount of the sheet P detected by the first CIS 35 and the lateral displacement amount of the sheet P detected by the second CIS 36. Then, the angular displacement amount β of the sheet P is detected by the first CIS 35 and the second CIS 36. It is to be noted that the lateral displacement amounts are detected directly by the first CIS 35 and the second CIS 36 when the sheet P is deviated in the rotational direction. Therefore, based on the detection results of the angular displacement amounts, the controller 90 (a calculator) calculates the lateral displacement amount α of the sheet P in a case in which the sheet P has no angular displacement.

Figure 9C:
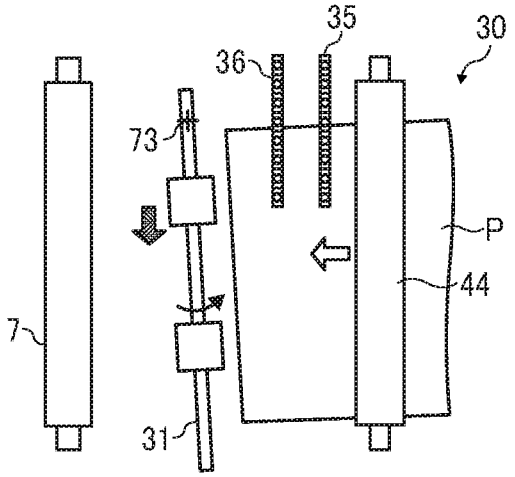
Figure 9D:
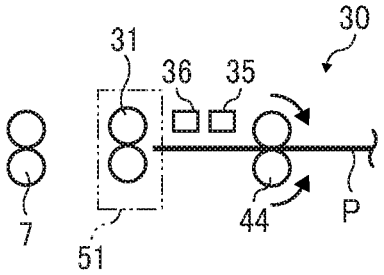

Then, as illustrated in FIGS. 9C and 9D, the pair of sheet holding rollers 31 together with the holding member 72 moves from the first home position by the angle β about the support shaft 73 in the same angular direction as the angular displacement amount β that is detected by the first CIS 35 and the second CIS 36 and at the same time moves from the second home position by the distance α in the same width direction as the lateral displacement amount α that is detected by the first CIS 35 and the second CIS 36.

Figure 9E:
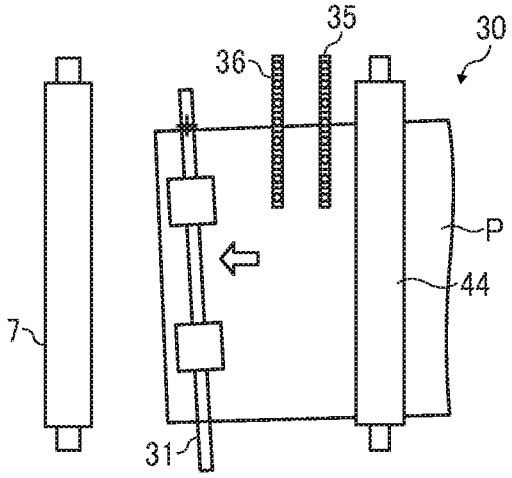
Figure 9F:
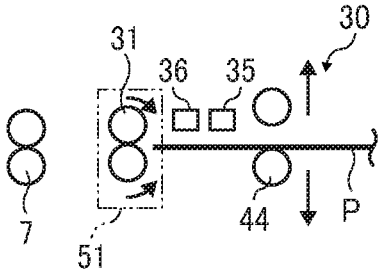

Then, as illustrated in FIGS. 9E and 9F, the pair of sheet holding rollers 31 starts to rotate (in a direction indicated by arrow in FIG. 9F) immediately before the leading end of the sheet P reaches the pair of sheet holding rollers 31. Consequently, as the sheet P is held and conveyed by the pair of sheet holding rollers 31, the third pair of sheet conveying rollers 44 opens the sheet conveyance passage and moves to a direction indicated by arrow in FIG. 9F in which the third pair of sheet conveying rollers 44 does not hold the sheet P.

It is to be noted that the calculator (i.e., the controller 90) can obtain a time at which the leading end of the sheet P contacts the pair of sheet holding rollers 31, based on a time at which the first CIS 35 and the second CIS 36 detect the leading end of the sheet P, a speed of conveyance of the sheet P and a distance from the positions of the first CIS 35 and the second CIS 36 to the position of the pair of sheet holding rollers 31.

Figure 10A:
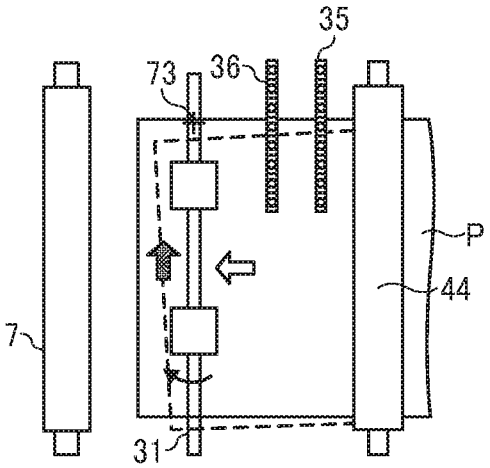
FIGS. 10A, 10B, 10C and 10D are diagrams illustrating operations of the sheet conveying device, subsequent from the operations of FIGS. 9A through 9F.
Figure 10B:
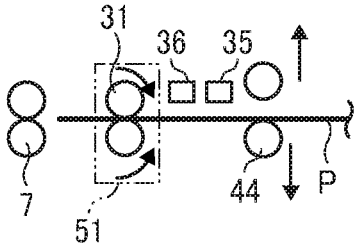

Then, as illustrated in FIGS. 10A and 10B, while holding and conveying the sheet P, the pair of sheet holding rollers 31 rotates about the support shaft 73 to return to the first home position such that the angular displacement amount β of the sheet P detected by the first CIS 35 and the second CIS 36 is cancelled, and at the same time moves in the width direction to return to the second home position such that the lateral displacement amount α of the sheet P detected by the first CIS 35 and the second CIS 36 is cancelled.

Figure 10C:
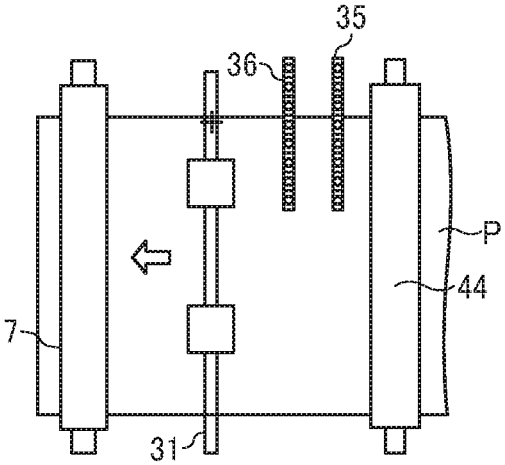
Figure 10D:
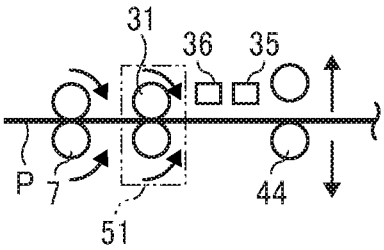

Then, as illustrated in FIGS. 10C and 10D, after the angular and lateral displacements of the sheet P are corrected, the sheet P is conveyed toward the transfer roller 7 (the transfer nip region). At this time, the number of rotations of the pair of sheet holding rollers 31 (the speed of conveyance of the sheet P until the sheet P arrives the transfer roller 7) is varied so as to synchronize with movement of the toner image formed on the surface of the photoconductor drum 5. Accordingly, the toner image is formed on the sheet P at a desired position.

Further, the third pair of sheet conveying rollers 44 in the roller separated state is returned to the roller contact state, as illustrated in FIG. 9B, for preparation of conveyance of the subsequent sheet P.

Now, a detailed description is given of a configuration and functions of the sheet conveying device 30 according to Embodiment 1, with reference to FIGS. 11A through 17.

As described above, in Embodiment 1, the sheet conveying device 30 includes the second drive device (i.e., the second drive motor 63, the lever 81, the cam follower 82, the roller 83, the first cam 84 and the timing belt 98). The second drive device is rotatable in the angular direction (i.e., a direction parallel to a plane of the sheet P) relative to the sheet conveying direction. Consequently, in a regular sheet conveyance process or regular sheet conveyance processes (the image forming processes), before the sheet P is conveyed to the pair of sheet holding rollers 31, the second drive device causes the pair of sheet holding rollers 31 to rotate from the home position (i.e., the first home position) according to the angular displacement of the sheet P, based on the detection results of the first CIS 35 and the second CIS 36 (i.e., both function as a second detector), so that the pair of sheet holding rollers 31 is brought to face the sheet P. Then, the second drive device causes the pair of sheet holding rollers 31 that is holding the sheet P to rotate to the home position (i.e., the first home position) so as to correct the angular displacement of the sheet P.

Figure 11:
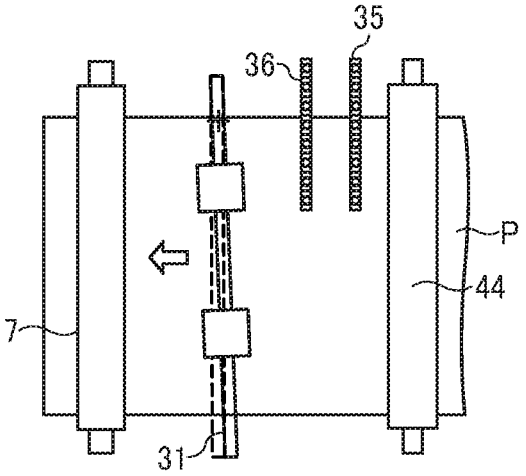
FIG. 11 is a diagram illustrating a home position of a pair of sheet holding rollers in the angular direction is displaced.
Figure 12A:
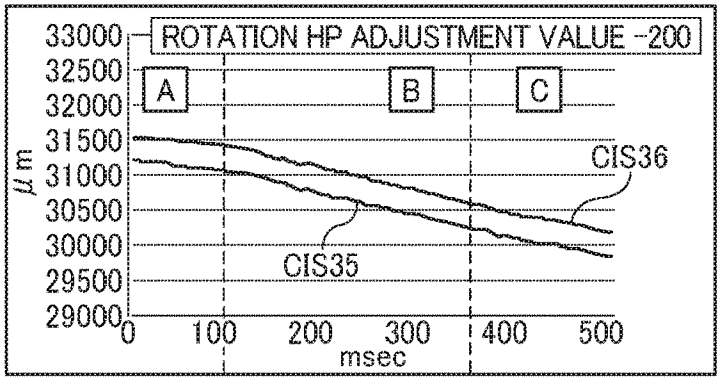
FIGS. 12A, 12B, 12C, 12D and 12E are graphs illustrating detection results of two CISs at five different steps of the pair of sheet holding rollers in the rotational direction.
Figure 12B:
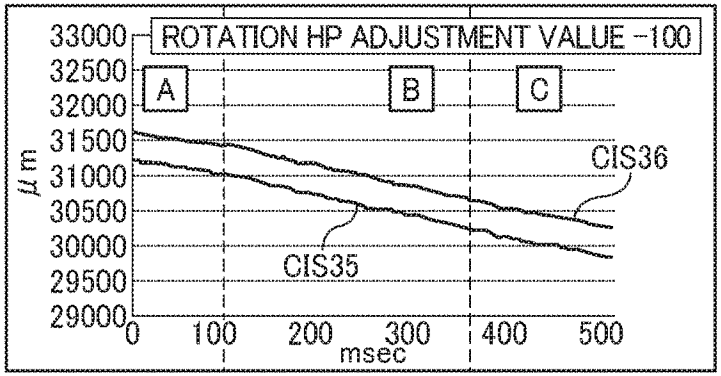
Figure 12C:
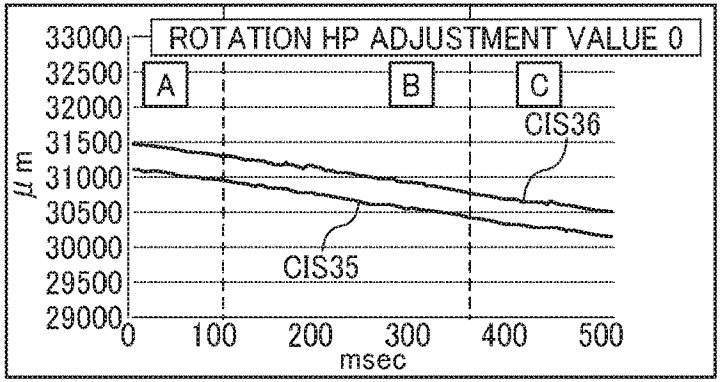
Figure 12D:
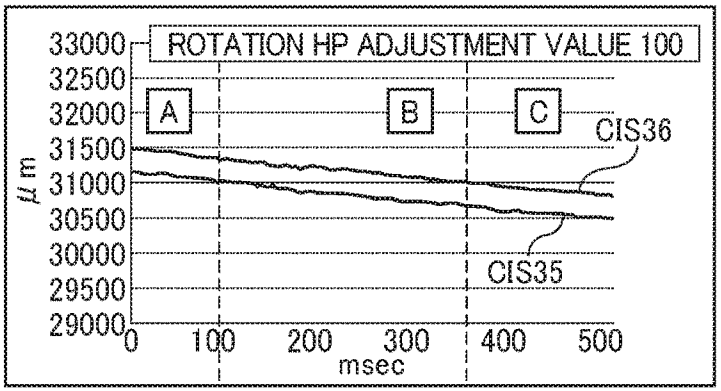
Figure 12E:
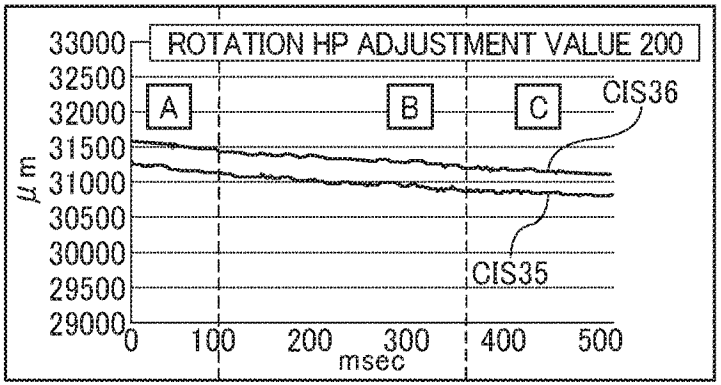

However, due to errors in assembly and parts such as the pair of sheet holding rollers 31, as illustrated in FIG. 11, it is likely that the first home position of the pair of sheet holding rollers 31 comes out of a target position (a position illustrated with a broken line).

To be more specific, in addition to errors in assembly and parts of a rotary mechanism such as the pair of sheet holding rollers 31, the holding member 72 and the base frame 71 and errors in assembly and parts of the second drive device (i.e., the second drive motor 63, the lever 81, the cam follower 82, the roller 83, the first cam 84 and the timing belt 98) that drives the pair of sheet holding rollers 31 to rotate in the angular direction, it is also likely that the first home position of the pair of sheet holding rollers 31 comes out of the target position due to errors in assembly and parts of the photosensor 15 and the feeler 84*b* (of the first cam 84) that detect the first home position of the pair of sheet holding rollers 31. Specifically, the pair of sheet holding rollers 31 is rotatably held by the sheet conveying device 30 via multiple parts in the angular direction and is not held by the apparatus body of the image forming apparatus 1 (or the sheet conveying device 30) via the bearing, such as the third pair of sheet conveying rollers 44 disposed upstream therefrom, the transfer roller 7 (and the photoconductor drum 5) disposed downstream therefrom. Therefore, as the above-described various errors in assembly and parts increase to be accumulated, the deviation of the first home position becomes too great to ignore.

Consequently, as illustrated in FIG. 11, if the first home position of the pair of sheet holding rollers 31 that functions as a first pair of rollers comes out of a target position, the pair of sheet holding rollers 31 cannot perform correction of position of the sheet P with high accuracy. Further, when the first home position of the pair of sheet holding rollers 31 that functions as a first pair of rollers comes out of a target position, the pair of sheet holding rollers 31 and the transfer roller 7 (and the photoconductor drum 5) that functions as a second pair of rollers (a pair of downstream side sheet conveying rollers) hold and convey the sheet P with an insufficient tolerance therebetween. As a result, the sheet P is stretched in the width direction between the pair of sheet holding rollers 31 and the transfer roller 7 (and the photoconductor drum 5), thereby generating creases on the sheet P.

In order to address the above-described inconveniences, the sheet conveying device 30 according to Embodiment 1 adjusts the angular home position (the first home position) in the angular direction of the pair of sheet holding rollers 31 at a predetermined time. This operation is occasionally referred to as a "home position adjustment mode." Accordingly, the pair of sheet holding rollers 31 enhances the accuracy in correction of angular displacement of the sheet P and the failure to generate creases on the sheet P that is held and conveyed by the pair of sheet holding rollers 31 is reduced.

Here, the sheet conveying device 30 in Embodiment 1 includes the controller 90 (see FIG. 16) to perform operations in the home position adjustment mode. Specifically, in the home position adjustment mode, the second drive device (i.e., the second drive motor 63, the lever 81, the cam follower 82, the roller 83, the first cam 84 and the timing belt 98) is caused to rotate the pair of sheet holding rollers 31 (i.e., a first pair of rollers) to multiple angles in the direction parallel to the plane of the sheet P, to cause the first CIS 35 and the second CIS 36 (i.e., both of which function as a detector), to detect time changes at each of the multiple angles at the lateral end face Pa of the sheet P while the pair of sheet holding rollers 31 and the pair of downstream side sheet conveying rollers (i.e., the transfer roller 7 and the photoconductor drum 5) (i.e., a second pair of rollers) hold and convey the sheet P at each of the multiple angles, and determine a home position corresponding to a position where a rate of the time change after the sheet P has reached the nip region of the pair of sheet holding rollers 31 is substantially identical to a rate of the time change after the sheet P has reached the transfer nip region formed by the pair of downstream side sheet conveying rollers. Specifically, the above-described position where a difference of these rates of time changes substantially matches is calculated to set the position as the home position.

To be more specific, the "home position adjustment mode" is used to determine a home position by causing the second drive device (i.e., the second drive motor 63, the lever 81, the cam follower 82, the roller 83, the first cam 84 and the timing belt 98) to rotate the pair of sheet holding rollers 31 (i.e., a first pair of rollers) to multiple angles in the direction parallel to the plane of the sheet P, causing the first CIS 35 and the second CIS 36 to detect the time changes at each of the multiple angles at the lateral end face Pa of the sheet P while the pair of sheet holding rollers 31 and the pair of downstream side sheet conveying rollers (i.e., the transfer roller 7 and the photoconductor drum 5) (i.e., a second pair of rollers) are holding and conveying the sheet P at each of the multiple angles, calculating a rotation position where a rate of the time change after the sheet P has reached the nip region of the pair of sheet holding rollers 31 is substantially identical to a rate of the time change after the sheet P has reached the transfer nip region formed by the pair of downstream side sheet conveying rollers, and setting the rotation position as the home position (based on the rates of the time changes).

It is to be noted that the above-described "rate of a time change" indicates a rate of change of a vertical component (position) relative to a horizontal component (time) in a graph of FIG. 12. Assuming that the graph has a straight line, the rate of change corresponds to a "gradient."

From another point of view, the "home position adjustment mode" is used to cause the second drive device (i.e., the second drive motor 63, the lever 81, the cam follower 82, the roller 83, the first cam 84 and the timing belt 98) to change the angular direction of the pair of sheet holding rollers 31 to multiple angles, cause the first CIS 35 and the second CIS 36 (both of which function as a detector) to detect the change of position at the lateral end face Pa of the sheet P while the pair of sheet holding rollers 31 and the pair of downstream side sheet conveying rollers (i.e., the transfer roller 7 and the photoconductor drum 5) (i.e., a second pair of rollers) are holding and conveying the sheet P at each of the multiple angles, and determine an angular home position (i.e., the first home position) of the pair of sheet holding rollers 31 so that the above-described change (the time change) becomes a linear change based on the detection results of the first CIS 35 and the second CIS 36. That is, the "home position adjustment mode" is a mode to cause the second drive device to change the angular direction of the pair of sheet holding rollers 31 to multiple angles, cause the first CIS 35 and the second CIS 36 to detect the change of position at the lateral end face Pa of the sheet P while the pair of sheet holding rollers 31 is holding and conveying the sheet P at each of the multiple angles, and determine an angular home position (i.e., the first home position) of the pair of sheet holding rollers 31 so that the above-described change becomes a linear change based on the detection results of the first CIS 35 and the second CIS 36.

Specifically, in the "home position adjustment mode" in Embodiment 1, the second drive device (i.e., the second drive motor 63, the lever 81, the cam follower 82, the roller 83, the first cam 84 and the timing belt 98) changes the angular direction of the pair of sheet holding rollers 31 to multiple angles, the first CIS 35 and the second CIS 36 detect the change of position of the lateral end face Pa of the sheet P at each of the multiple angles while the pair of sheet holding rollers 31 is holding and conveying the sheet P at each of the multiple angles, over a period before and after the sheet P is held and conveyed by the transfer roller 7 and the photoconductor drum 5 (i.e., the pair of downstream side sheet conveying rollers), and the angular home position (i.e., the first home position) of the pair of sheet holding rollers 31 is determined so that the above-described change becomes a linear change based on the above-described detection results of the first CIS 35 and the second CIS 36.

It is to be noted that the "home position adjustment mode" is a control to cause the pair of sheet holding rollers 31 to hold and convey the sheet P at each of the multiple angles to determine the first home position and is performed at a time at which any of the regular sheet conveyance processes (the image forming processes) is not performed. The controller 90 controls the pair of sheet holding rollers 31 (the first pair of rollers) to hold and convey the sheet P at each of the multiple angles to determine the first home position at a time at which any of the regular sheet conveyance processes is not performed. That is, when the "home position adjustment mode" is performed, a test sheet P is conveyed from a selected one of the first sheet feeding unit 12, the second sheet feeding unit 13 and the third sheet feeding unit 14 through the sheet conveyance passage, which is similar to the regular image forming operations, but no image is to be formed on the surface of the test sheet P.

It is to be noted that a test sheet P to be conveyed in the home position adjustment mode preferably has the high linearity of the lateral end face Pa.

A further detailed description is given of the home position adjustment mode according to Embodiment 1.

In the "home position adjustment mode", an angle of inclination θ of the pair of sheet holding rollers 31 is prepared at multiple levels, θ1 through θ5 (see FIG. 17), and the sheet P is conveyed repeatedly. Then, the controller 90 calculates the angle of inclination θ whose transition of detected data is closest to a straight line (i.e., an angle of inclination θ that is substantially identical to the rate of time change), and the angle of inclination θ is determined as the first hoe position. If the sheet P is held and conveyed by the pair of sheet holding rollers 31 while the pair of sheet holding rollers 31 is rotated in the angular direction, the sheet P is conveyed with the angular displacement according to the angle of inclination θ. Therefore, the transition of time of the detected data of the first CIS 35 and the second CIS 36 (the rates of time change) changes at a constant increase and decrease along with the angular displacement amount of the sheet P and the conveyance of the sheet P. However, if the tolerance between the pair of sheet holding rollers 31 and the pair of upstream side sheet conveying rollers or the pair of downstream side sheet conveying rollers (especially, the pair of downstream side sheet conveying rollers) is not sufficient, the level of the tolerance changes (increases or decreases), thereby causing a failure in correction of the angular displacement or generating creases. Consequently, the rotation position (the angle of inclination θ) of the pair of sheet holding rollers 31 having the least amount of change (increase or decrease) is derived.

It is to be noted that, in the home position adjustment mode, the rollers of the pair of sheet holding rollers 31 and the rollers of the third pair of sheet conveying rollers 44 are not separated.

Figure 17:
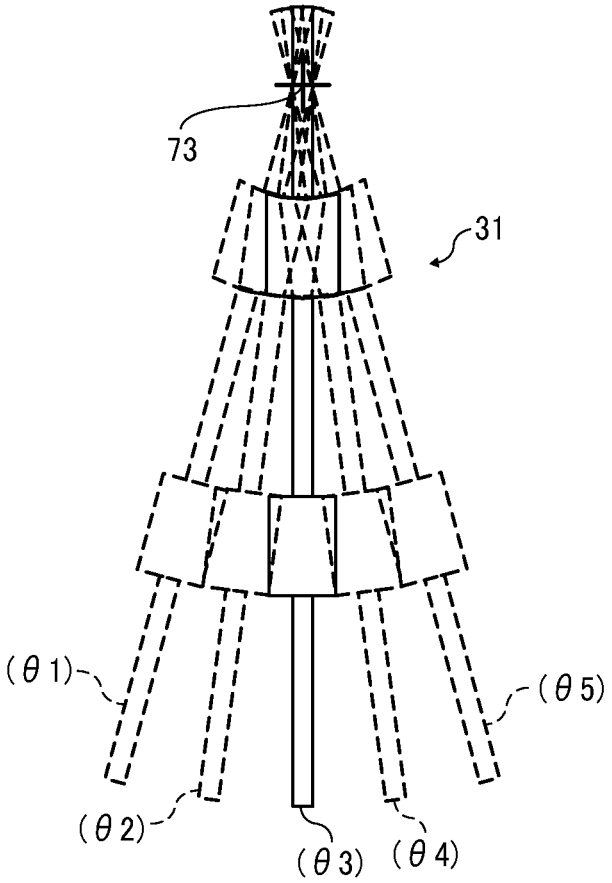
FIG. 17 is a diagram illustrating movement of the pair of sheet holding rollers in a home position adjustment mode.

To be more specific, in Embodiment 1, the angle of inclination θ of the pair of sheet holding rollers 31 is set to five different steps (five levels) from θ1 to θ5, as illustrated in FIG. 17. With each level of the settings, a test sheet P is conveyed while the rotation position of the pair of sheet holding rollers 31 is fixed, and the detection results of the lateral end face Pa of the sheet P obtained by the first CIS 35 and the second CIS 36 are measured.

FIGS. 12A, 12B, 12C, 12D and 12E are graphs illustrating detection results of the first CIS 35 and the second CIS 36 at five different settings (from θ1 to θ5) of the pair of sheet holding rollers 31 in the rotational direction. The horizontal axis indicates time (mm/sec) and the vertical axis indicates position of the lateral end face Pa of the sheet P. In other words, FIGS. 12A, 12B, 12C, 12D and 12E illustrate respective time changes of the position of the lateral end face Pa of the sheet P. Further, in FIGS. 12A through 12E, the term "CIS 35" represents detection results obtained by the first CIS 35 and the term "CIS 36" represents detection results obtained by the second CIS 36. Further, in FIGS. 12A through 12E, when the time is 100 mm/sec., the sheet P has reached the nip region of the pair of sheet holding rollers 31. By contrast, when the time is 350 mm/sec., the sheet P has reached the transfer nip region of the pair of downstream side sheet conveying rollers.

As illustrated in FIGS. 12A through 12E, the amounts of gradient of the line in the graph having the change of the tolerance are different, based on the angle of inclination θ of the pair of sheet holding rollers 31. However, there are changes in the straight line due to the tolerance between the nip region of the pair of sheet holding rollers 31 and the transfer nip region of the pair of downstream side sheet conveying rollers, before and after the sheet reaches the nip regions. Respective changes in amounts of gradient of the line (rates of time change) in the graph are generated in three sections divided by broken lines in FIGS. 12A through 12E, which are Sections A, B and C. That is, the amounts of gradient of the line (the rates of time change) obtained by straight-line approximation in Sections A, B and C change. The change of gradient is a change of a position of the sheet P in the width direction that is generated due to difference of the sheet conveying direction of the pair of sheet holding rollers 31 and the sheet conveying direction of the pair of upstream side sheet conveying rollers or the pair of downstream side sheet conveying rollers. For example, when a rotation home position (HP) adjustment value is −200, the gradient of the line in Section A of the graph and the gradient of the line in Section B of the graph are different.

Figure 13:
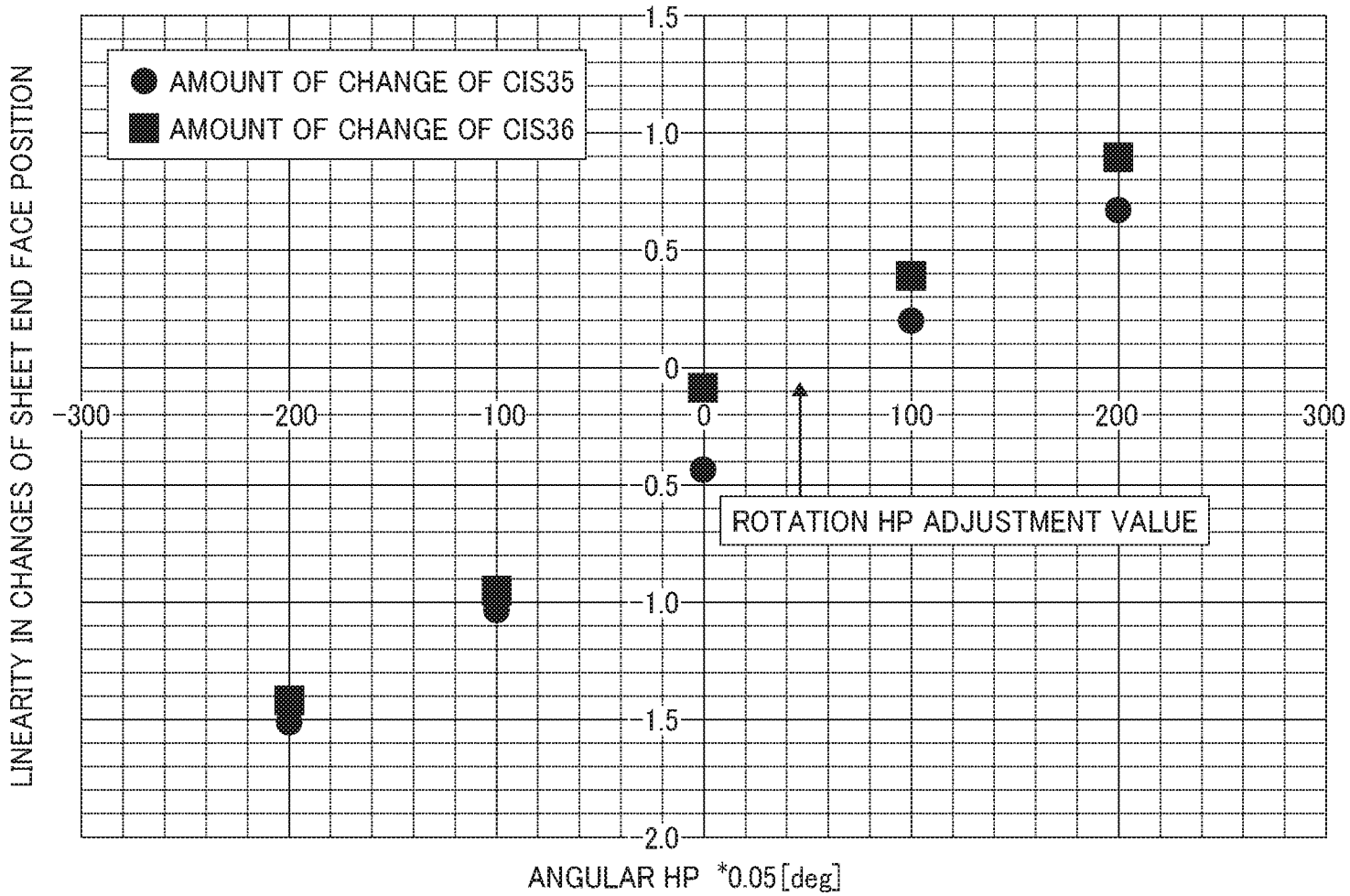
FIG. 13 is a graph illustrating values totalizing a relation of the displacement angle of the pair of sheet holding rollers and the linearity of change of position of an end face of a sheet, based on the detection results of FIGS. 12A, 12B, 12C, 12D and 12E.

FIG. 13 is a graph illustrating values generated by plotting the angles of inclination θ and the amounts of changes of the gradient of the lines in Sections B and C in the graphs. The horizontal axis of the graph indicates the angle of inclination of the pair of sheet holding rollers 31 and the vertical axis indicates the linearity in changes of position of the lateral end face of the sheet P, based on the detection results of FIG. 12.

In the example of FIG. 13, a rotation HP adjustment value having the least amount of change of the gradient of the line in the graph (that is, a linearity of change of position of the end face of the sheet P and consistency of rates of time changes between sections B and C) is located at approximately 50. That is, when the first home position of the pair of sheet holding rollers 31 is set such that the angle of inclination θ of the pair of sheet holding rollers 31 corresponds to the rotation HP adjustment value, 50, the change of position of the lateral end face Pa of the sheet P detected by the first CIS 35 and the second CIS 36 becomes linear. Consequently, by performing the regular sheet conveyance processes under the adjustment of the first home position, the tolerance of the pair of sheet holding rollers 31 and the transfer roller 7 (and the photoconductor drum 5) is enhanced, thereby performing angular displacement of the sheet P with high accuracy and reducing generation of creases.

Here, in Embodiment 1, the controller 90 performs the "home position adjustment mode" to set the home position by causing the second drive device (i.e., the second drive motor 63, the lever 81, the cam follower 82, the roller 83, the first cam 84 and the timing belt 98) to rotate the pair of sheet holding rollers 31 (i.e., a first pair of rollers) to multiple angles in the direction parallel to the plane of the sheet P, causing the first CIS 35 and the second CIS 36 (i.e., both of which function as a detector) to detect time changes at the lateral end face Pa of the sheet P while at least the pair of sheet holding rollers 31 and the pair of downstream side sheet conveying rollers (i.e., the transfer roller 7 and the photoconductor drum 5), out of the third pair of sheet conveying rollers 44 (i.e., the upstream side sheet conveying rollers) and the pair of sheet holding rollers 31 and the pair of downstream side sheet conveying rollers, are holding and conveying the sheet P at each of the multiple angles, and determining the home position corresponding to a position where a rate of the time change after the sheet P has reached the nip region of the pair of sheet holding rollers 31 is substantially identical to a rate of the time change after the sheet P has reached the transfer nip region formed by the pair of downstream side sheet conveying rollers.

From another point of view, the "home position adjustment mode" is used to cause the second drive device (i.e., the second drive motor 63, the lever 81, the cam follower 82, the roller 83, the first cam 84 and the timing belt 98) to change the angular direction of the pair of sheet holding rollers 31 to multiple angles, cause the first CIS 35 and the second CIS 36 (both of which function as a detector) to detect the change of position at the lateral end face Pa of the sheet P in a period from a time before the sheet P reaches the pair of sheet holding rollers 31 to a time the sheet P is held and conveyed by the transfer roller 7 (i.e., the pair of downstream side sheet conveying rollers) while at least one of the pair of sheet holding rollers 31 and the third pair of sheet conveying rollers 44 (i.e., the pair of upstream side sheet conveying rollers) are holding and conveying the sheet P at each of the multiple angles, and determine an angular home position (i.e., the first home position) of the pair of sheet holding rollers 31 so that the above-described change becomes a linear change based on the detection results of the first CIS 35 and the second CIS 36.

That is, the amounts of change of the gradient of each line in Sections A and B in FIG. 12 are also plotted in FIG. 13, so that the angle of inclination θ of the pair of sheet holding rollers 31 having no amount of change (the value of zero) is determined as the first home position.

In a case in which a sheet P having a transparent color or a black color is conveyed in the regular sheet conveyance processes (the image forming processes), it is difficult for the first CIS 35 and the second CIS 36 to detect the lateral end face Pa of the sheet P optically, and therefore there are cases that angular displacement and lateral displacement of the sheet P are not controlled. In such cases, the rollers of the third pair of sheet conveying rollers 44 are not separated and are controlled to be in contact with each other constantly. In these cases, if the third pair of sheet conveying rollers 44 and the pair of sheet holding rollers 31 hold and convey the sheet P with an insufficient tolerance therebetween, the third pair of sheet conveying rollers 44 and the pair of sheet holding rollers 31 generate creases on the sheet P being held and conveyed. Accordingly, the above-described home position adjustment mode is useful.

Further, the first CIS 35 and the second CIS 36 are used as detectors in the "home position adjustment mode" in Embodiment 1. However, it is not limited to use both of the first CIS 35 and the second CIS 36 but one of the first CIS 35 and the second CIS 36 may be used as a detector in the "home position adjustment mode." However, in a case in which the first CIS 35 and the second CIS 36 disposed apart from each other in the sheet conveying direction are used as described in Embodiment 1, even when the lateral end face Pa of the sheet P has unevenness and low linearity, the lateral end face Pa of the sheet P is determined based on both of the detection results. Accordingly, the first home position of the pair of sheet holding rollers 31 is determined with relatively high accuracy.

Further, the angle of inclination θ of the pair of sheet holding rollers 31 is set selectively from five (5) levels in the "home position adjustment mode" in Embodiment 1. However, the levels of the angle of inclination are not limited thereto and any other numbers other than one (1) may be set for the levels of the angle of inclination θ of the pair of sheet holding rollers 31.

It is to be noted that, in Embodiment 1, the "home position adjustment mode" is not performed for one time before the sheet conveying device 30 (the image forming apparatus 1) is started but is performed for multiple times, at predetermined intervals, at each time when the number of accumulated sheets reaches the predetermined value.

The home position adjustment mode is performed for multiple times at the predetermined time because the errors in assembly and various parts previously described (especially, parts errors) vary due to wear and degrade by change of time, and therefore the first home position that has previously been adjusted changes.

Even in change of time, by timely performing the "home position adjustment mode", the angular displacement of the sheet P is corrected with high accuracy and generation of creases on the sheet P is reduced.

It is to be noted that, in the "home position adjustment mode" in Embodiment 1, the controller 90 calculates the rotation position where a rate of the time change after the sheet P has reached the nip region of the pair of sheet holding rollers 31 is substantially identical to a rate of the time change after the sheet P has reached the transfer nip region formed by the pair of downstream side sheet conveying rollers (i.e., the transfer roller 7 and the photoconductor drum 5) and determines the calculated rotation position as the first home position.

By contrast, in the "home position adjustment mode", the controller 90 causes the second drive device (i.e., the second drive motor 63, the lever 81, the cam follower 82, the roller 83, the first cam 84 and the timing belt 98) to rotate the pair of sheet holding rollers 31 (i.e., a first pair of rollers) to multiple angles in the direction parallel to the plane of the sheet P, causes the first CIS 35 and the second CIS 36 (i.e., both of which function as a detector) to detect time changes at the lateral end face Pa of the sheet P while the pair of sheet holding rollers 31 and the pair of downstream side sheet conveying rollers (i.e., the transfer roller 7 and the photoconductor drum 5) (i.e., a second pair of rollers) are holding and conveying the sheet P at each of the multiple angles, and determines the home position corresponding to the rotation position where there is a least or smallest difference of a rate of the time change after the sheet P has reached the nip region of the pair of sheet holding rollers 31 and a rate of the time change after the sheet P has reached the transfer nip region formed by the pair of downstream side sheet conveying rollers. Specifically, one rotation position where a difference of the above-described rates of time changes becomes smallest may be obtained among the multiple angles (levels) to set the selected rotation position as the home position.

Specifically, with reference to examples of FIGS. 12A through 12E and 13, among the five levels of the angles of inclination of the pair of sheet holding rollers 31, the angle of inclination θ having the least amount of change of the gradient of the line in the graph having the rotation HP adjustment value of 100 (that is, the linearity of change of position of the end face of the sheet P and consistency of rates of time changes between Sections B and C) is determined as the first home position.

Consequently, even when the home position (the first home position) is thus controlled, the tolerance of the pair of sheet holding rollers 31 and the transfer roller 7 (and the photoconductor drum 5) is enhanced, thereby performing angular displacement of the sheet P with high accuracy and reducing generation of creases.

Figure 14:
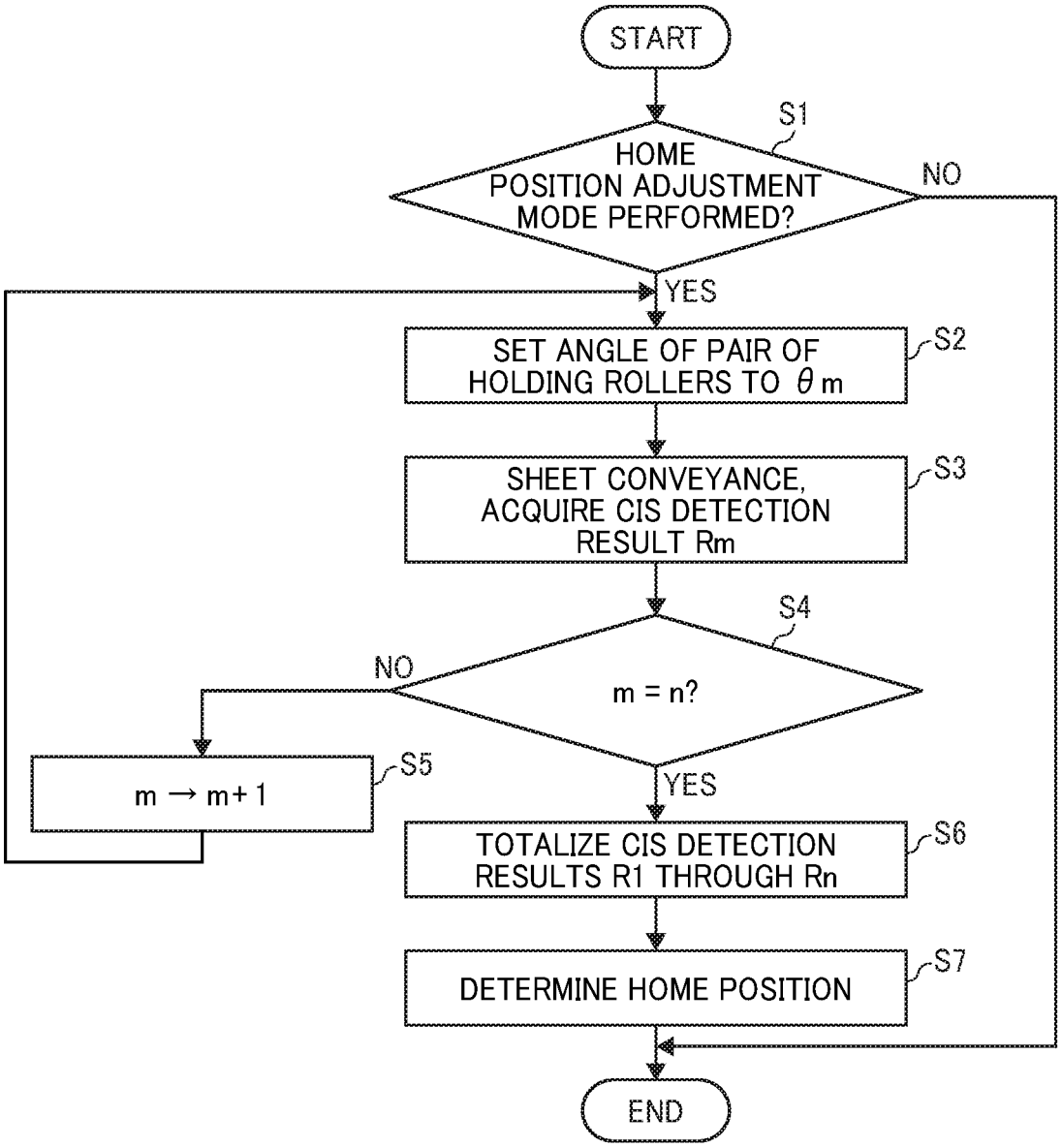
FIG. 14 is a flowchart of control in a home position adjustment mode.

Next, a description is given of summary of control operations in the home position adjustment mode, with reference to the flowchart of FIG. 14.

As illustrated in FIG. 14, the controller 90 determines whether it is a time to execute the home position adjustment mode, in step S1. When the controller 90 determines that it is not a time to execute the home position adjustment mode (NO in step S1), the control operations are terminated. When the controller 90 determines that it is a time to execute the home position adjustment mode (YES in step S1), the home position adjustment mode is started.

In step S2, the second drive device including the second drive motor 63, the lever 81, the cam follower 82, the roller 83, the first cam 84 and the timing belt 98) causes the pair of sheet holding rollers 31 to set the angle of inclination to θ1. In step S3, while the pair of sheet holding rollers 31 is remained to the angle of inclination θ1, a test sheet P is conveyed, and the first CIS 35 and the second CIS 36 detect the lateral end face Pa of the sheet P, and acquires a test result R1. In step S4, the controller 90 determines whether the number "m" of step (level) of the angle of inclination equals to a specified number "n" of step (level) of the angle of inclination. When the controller 90 determines that the number "m" is equal to the specified number "n" (YES in step S4), the process goes to step S6. When the controller 90 determines that the number "m" is not equal to the specified number "n" (NO in step S4), the number "m" is incremented by 1 (m+1) in step S5, and starts step S2 again. Steps S2 through S5 are repeated according to the specified number "n" ("5" in Embodiment 1). Specifically, in steps S2 through S5, the number "m" is incremented by 1 up to the specified number "n" after the setting of the angle of inclination θm (m=1 through n) of the pair of sheet holding rollers 31, the conveyance of the sheet P under the setting conditions and the acquisition of the detection result Rm (m=1 through n). That is, the angle of inclination θ of the pair of sheet holding rollers 31 is sequentially changed from θ1 to θ5 (see FIG. 17), and any one of detection results R1 through R5 obtained by the first CIS 35 and the second CIS 36 corresponding to the respective one of the angles of inclination θ1 to through θ5.

Then, the detection results R1 through Rn are totalized, in step S6, and the home position (i.e., the first home position) of the pair of sheet holding rollers 31 is determined such that the change of the detection results is linear, in step S7. After completion of step S7, the flow of control operations is finished.

Then, the home position adjustment mode is executed and until the home position of the pair of sheet holding rollers 31 is changed, the correction of angular displacement is controlled based on the value of the home position (the angle of inclination).

Now, referring to FIGS. 15 and 16, a description is given of the correction of angular displacement of the sheet P and the correction of lateral registration of the sheet P performed in the sheet conveying device 30 according to Embodiment 1 of this disclosure previously described with reference to FIGS. 9 and 10.

Figure 15:
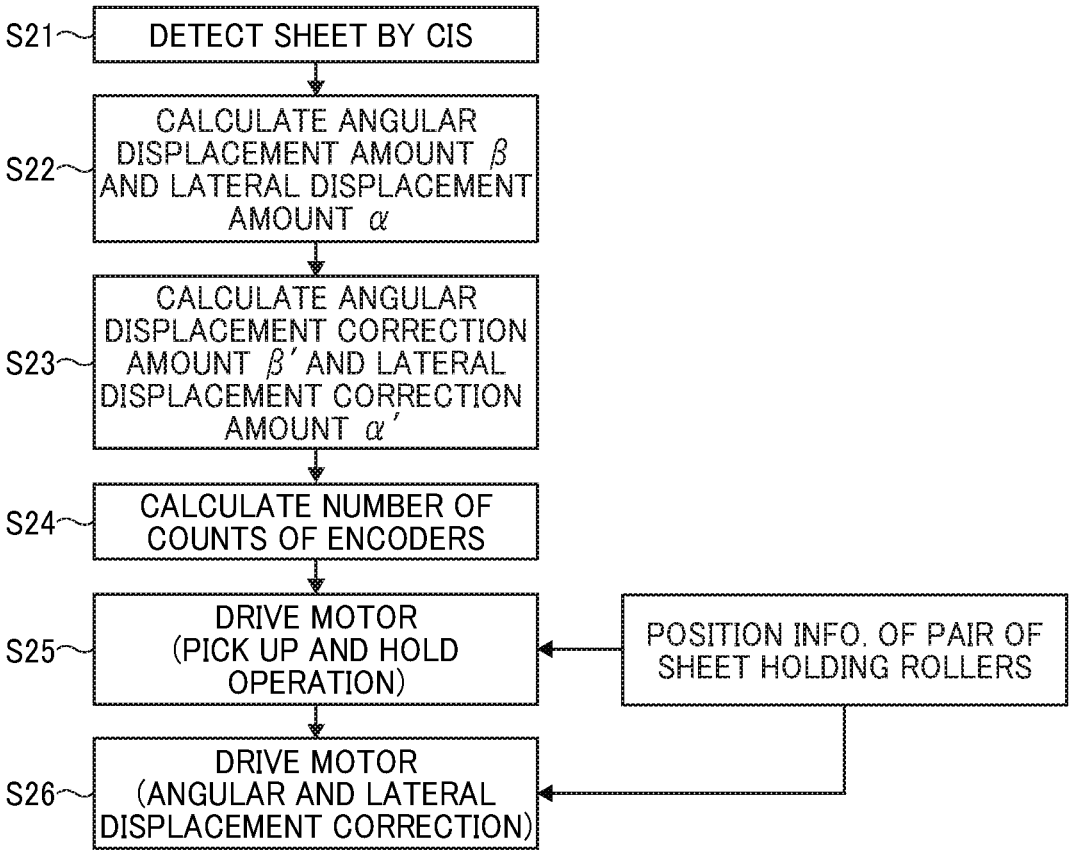
FIG. 15 is a flowchart of control of an angular displacement correction and a lateral displacement correction.

FIG. 15 is a flowchart of control operations before the angular and lateral displacement corrections. FIG. 16 is a block diagram illustrating the controller 90 related to the angular and lateral displacement corrections in the flowchart of FIG. 15.

As illustrated in FIG. 15, two CISs (i.e., the first CIS 35 and the second CIS 36 in the primary correction) detect the sheet P, in step S21. Then, the CISs obtain the lateral displacement amount α of the sheet P and the angular displacement amount β of the sheet P, in step S22. Then, based on the detection results, the lateral displacement correction amount α' of the sheet P and the angular displacement correction amount β' of the sheet P are calculated, in step S23. By so doing, the lateral displacement correction amount α' of the sheet P and the angular displacement correction amount β' of the sheet P are determined.

Figure 16:
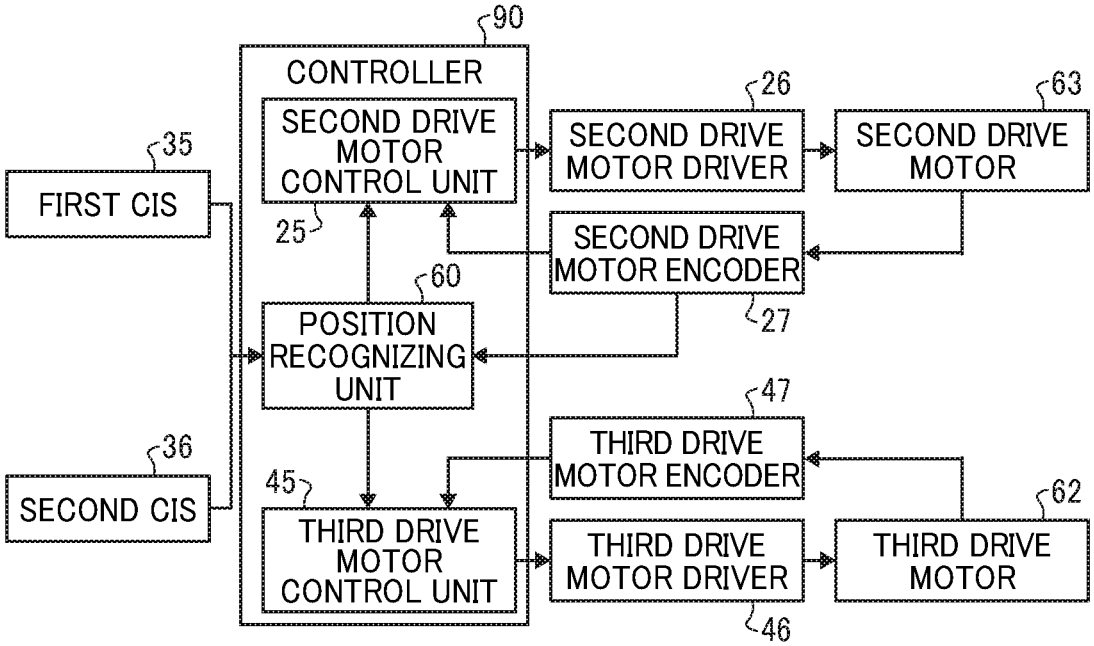
FIG. 16 is a block diagram illustrating a controller.

Then, based on the lateral displacement correction amount α' of the sheet P and the angular displacement correction amount β' of the sheet P, encoders, i.e., a second motor encoder 27 and a third motor encoder 47 in FIG. 16 calculate respective numbers of counts thereof, in step S24. Thereafter, according to the number of counts of the second motor encoder 27 and the number of counts of the third motor encoder 47, respective motor drivers, i.e., a second drive motor driver 26 and a third drive motor driver 46 in FIG. 16 drive the second drive motor 63 and the third drive motor 62, respectively, and the pair of sheet holding rollers 31 is rotated in the rotation direction and moved in the width direction to perform a pick up and hold operation, in step S25. While holding and conveying the sheet P driven by the second drive motor 63 and the third drive motor 62, the pair of sheet holding rollers 31 is rotated and moved to return to the home position. Accordingly, the pair of sheet holding rollers 31 performs the angular and lateral displacement corrections of the sheet P (i.e., an adjustment and feed operation), in step S26.

It is to be noted that, when the pick up and hold operation in step S25 and the angular and lateral displacement corrections of the sheet P in step S26 are performed, the second drive motor encoder 27 and the third drive motor encoder 47 feed back the position information of the pair of sheet holding rollers 31 continuously. Accordingly, the pair of sheet holding rollers 31 is controlled to move by the determined amount of movement.

In FIG. 16, the controller 90 controls various operations in the image forming apparatus 1. A position recognizing unit 60 in the controller 90 counts the amount of lateral displacement of the sheet P and the amount of angular displacement of the sheet P from information received from the first CIS 35 and the second CIS 36. Further, a second drive motor control unit 25 determines the amounts of driving of the second drive motor 63 (i.e., the angle and direction of rotation of the second drive motor 63) based on the amount of angular displacement of the sheet P obtained by the position recognizing unit 60. Further, a third drive motor control unit 45 determines the amounts of driving of the third drive motor 62 (i.e., the angle and direction of rotation of the third drive motor 62) based on the amount of lateral displacement of the sheet P obtained by the position recognizing unit 60. The second drive motor driver 26 receives a signal from the second drive motor control unit 25 to drive the second drive motor 63. Similarly, the third drive motor driver 46 receives a signal from the third drive motor control unit 45 to drive the third drive motor 62. The second drive motor encoder 27 detects the amount of rotation of the second drive motor 63 and the third drive motor encoder 47 detects the amount of rotation of the third drive motor 62.

As described above, the sheet conveying device 30 according to Embodiment 1 includes the controller 90 to set the home position corresponding to a rotation position where a rate of the time change after the sheet P has reached the nip region of the pair of sheet holding rollers 31 (i.e., a first pair of rollers) is substantially identical to a rate of the time change after the sheet P has reached the transfer nip region formed by the pair of downstream side sheet conveying rollers (i.e., the transfer roller 7 and the photoconductor drum 5) (i.e., a second pair of rollers), by causing the second drive device (i.e., the second drive motor 63, the lever 81, the cam follower 82, the roller 83, the first cam 84 and the timing belt 98) to rotate the pair of sheet holding rollers 31 to multiple angles in the direction parallel to the plane of the sheet P and causing the first CIS 35 and the second CIS 36 (i.e., both of which function as a detector) to detect time changes at the lateral end face Pa of the sheet P at each of the multiple angles while the pair of sheet holding rollers 31 and the pair of downstream side sheet conveying rollers are holding and conveying the sheet P.

According to this configuration, the sheet conveying device 30 performs the correction of angular displacement of the sheet P being conveyed in the predetermined sheet conveying direction with high accuracy.

Further, in Embodiment 1, this disclosure is applied to the sheet conveying device 30 in which the pair of sheet holding rollers 31 that functions as a pair of lateral and angular displacement correction rollers also functions as a pair of registration rollers. However, the configuration of a sheet conveying device to which this disclosure is applied is not limited thereto. As long as a sheet conveying device performs an angular displacement correction, this disclosure may be applied naturally. For example, this this disclosure may be applied to a sheet conveying device having a pair of registration rollers disposed downstream from the pair of sheet holding rollers 31 that functions as a pair of lateral and angular displacement correction rollers in the sheet conveying direction.

Further, in Embodiment 1, this disclosure is applied to the sheet conveying device 30 in which the angular and lateral displacement corrections of a transfer sheet as a sheet P on which an image is formed. However, the configuration of a sheet conveying device to which this disclosure is applied is not limited thereto. For example, this disclosure may be applied naturally to a sheet conveying device that performs the angular and lateral displacement corrections of an original document as a sheet P.

Further, in Embodiment 1, this disclosure is applied to the sheet conveying device 30 that is included in the image forming apparatus 1 that performs monochrome image formation. However, the configuration of an image forming apparatus to which this disclosure is applied is not limited thereto. For example, this disclosure may be applied naturally to a sheet conveying device that is included in a color image forming apparatus.

Further, even if any of the above-described configurations of the sheet conveying device 30 included in the image forming apparatus 1 is employed, the same effect as in Embodiment 1 can be achieved.

Further, in Embodiment 1, the home position (the first home position) is set by detecting time changes of the lateral end face Pa of the sheet P by the first CIS 35 and the second CIS 36 (both functioning as a detector) while the pair of sheet holding rollers 31 as a first pair of rollers and the pair of downstream side sheet conveying rollers including the transfer roller 7 and the photoconductor drum 5 as a second pair of rollers are holding and conveying the sheet P and by determining the home position based on the rate of the time change after the sheet P has reached the nip region of the pair of sheet holding rollers 31 and the rate of the time change after the sheet P has reached the transfer nip region of the pair of downstream side sheet conveying rollers. By contrast, the detectors detect the time changes of the lateral end face Pa of the sheet P while the first pair of rollers and the second pair of rollers that is disposed upstream from the first pair of rollers in the sheet conveying direction are holding and conveying the sheet P, and the home position (the first home position) is set based on the rate of the time change after the sheet P has reached the nip region of the second pair of rollers and the rate of the time change after the sheet P has reached the nip region formed by the second pair of rollers.

Further, even in the above-described case, the above-described configuration can achieve the same effect as each configuration of the sheet conveying device 30 according to Embodiment 1.

Embodiment 2

Figure 18:
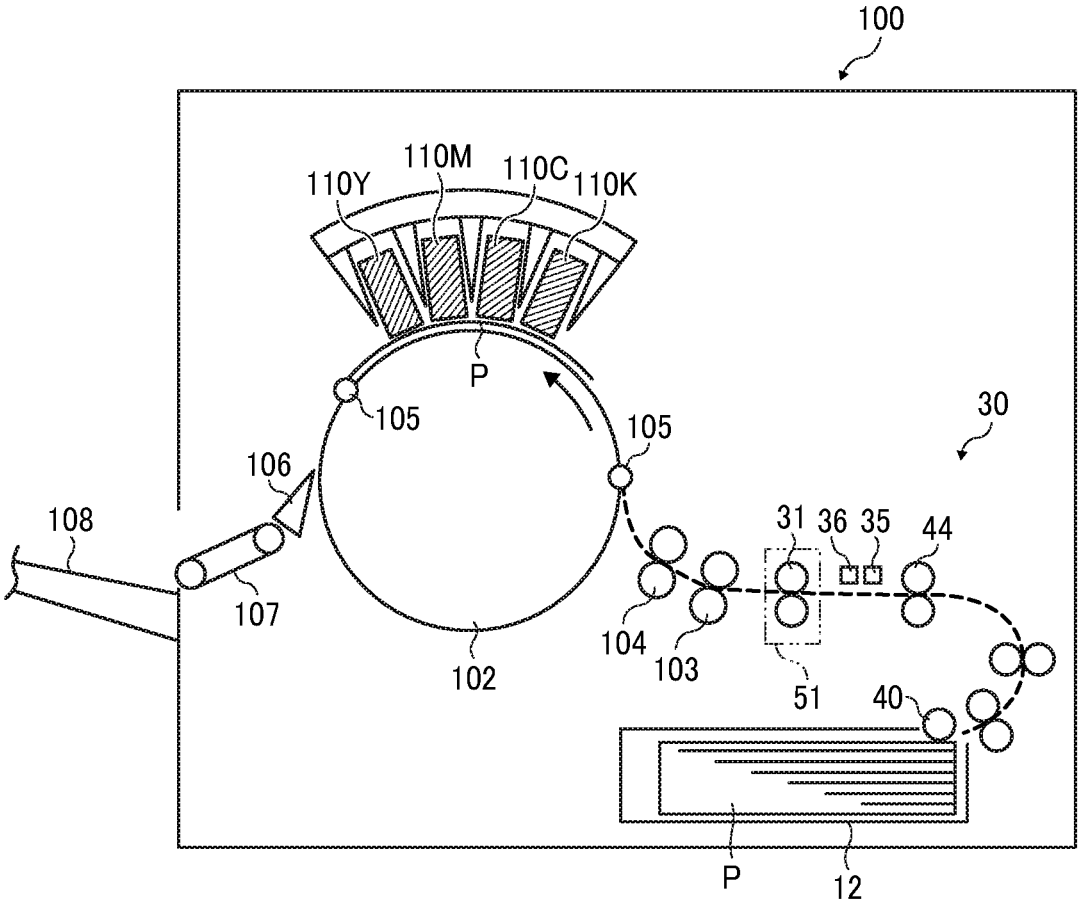
FIG. 18 is a diagram illustrating an overall configuration of an image forming apparatus according to Embodiment 2 of this disclosure.

Next, a description is given of a configuration and functions of the sheet conveying device 30 and an image forming apparatus 100, according to Embodiment 2 of this disclosure, with reference to FIG. 18.

FIG. 18 is a diagram illustrating an overall configuration of the image forming apparatus 100 according to Embodiment 2 of this disclosure. The configuration and functions of the image forming apparatus 100 illustrated in FIG. 18 according to Embodiment 2 is basically identical to the configuration and functions of the image forming apparatus 1 according to Embodiment 1, except that the image forming apparatus 100 according to Embodiment 2 is an inkjet printer while the image forming apparatus 1 according to Embodiment 1 is an electrophotographic image forming apparatus.

In FIG. 18, the image forming apparatus 100, that is, the inkjet printer, includes a conveyance drum 102, a pair of downstream side sheet conveying rollers 103, a pair of sheet conveying rollers 104, a sheet gripper 105, a separating member 106, a conveying belt 107, a sheet discharging tray 108, and ink print heads 110Y, 110M, 110C and 110K.

The conveyance drum 102 conveys the sheet P. The pairs of downstream side sheet conveying rollers 103 and 104 conveys the sheet P. The sheet gripper 105 grips the sheet P on the conveyance drum 102. The separating member 106 separates the sheet p from the conveyance drum 102. The conveying belt 107 conveys the sheet P separated from the conveyance drum 102. The sheet discharging tray 108 discharges and stacks the sheet P after image formation and printing is completed.

Each of the ink print heads 110Y, 110M, 110C and 110K is a single unit (i.e., a print module) including an image forming device to form and print an image with an inkjet method.

Similar to the electrophotographic image forming apparatus 1 according to Embodiment 1, the image forming apparatus 100 forming and printing an image with an inkjet method according to Embodiment 2 includes the sheet conveying device 30.

The image forming apparatus 100 according to Embodiment 2 is to form a color image and, as illustrated in FIG. 18, includes the ink print head 110K for black image and the ink print heads 110Y, 110M and 110C for three color images, which are yellow, magenta and cyan images, respectively. The four ink print heads 110Y, 110M, 110C and 110K are aligned to face the conveyance drum 102 along the rotation direction of the conveyance drum 102.

It is to be noted that the four ink print heads 110Y, 110M, 110C and 110K have the configuration identical to each other except for the ink colors (types). The ink print heads 110Y, 110M, 110C and 110K includes a piezoelectric actuator and a thermal actuator for a main part, nozzles used to discharge ink as liquid droplets, ink tanks filled with ink, a control board (a controller) and so forth.

Now, a description is given of operations performed by the image forming apparatus 100, with reference to FIG. 18.

First, as a print instruction is inputted together with image data from, for example, a personal computer to the controller of the image forming apparatus 100, the sheet P is fed by a sheet feed roller 40 from the first sheet feed unit 12. The sheet P fed from the first sheet feed unit 12 is conveyed by the sheet conveying device 30 to the conveyance drum 102. At this time, similar to Embodiment 1, in the sheet conveying device 30 of Embodiment 2, the pair of sheet holding rollers 31 that functions as a first pair of rollers performs the corrections of lateral and angular displacements of the sheet P based on the detection results of the first CIS 35 and the second CIS 36.

At the same time, the ink print heads 110Y, 110M, 110C and 110K convert and form image writing data based on the image data input to the controller.

Consequently, the sheet P conveyed to the conveyance drum 102 is positioned on the conveyance drum 102 while being gripped by the sheet gripper 105, and is conveyed in a counterclockwise direction along the rotation of the conveyance drum 102.

Then, based on the image writing data, ink as liquid droplets is sequentially sprayed from the ink print heads 110Y, 110M, 110C and 110K onto the sheet P conveyed in a direction indicated by arrow in FIG. 18 in response to the rotation of the conveyance drum 102. By so doing, a desired color image is formed on the sheet P.

Thereafter, the sheet P having the desired image thereon is separated from the conveyance drum 102 by the separating member 106. Then, the sheet P separated from the conveyance drum 102 is conveyed by the conveying belt 107 to be discharged to the sheet discharging tray 108.

As described above, similar to the sheet conveying device 30 according to Embodiment 1, the sheet conveying device 30 of the image forming apparatus 100 according to Embodiment 1 includes the controller 90 to cause the second drive device to rotate the pair of sheet holding rollers 31 that functions as a first pair of rollers to multiple angles in the direction parallel to the plane of the sheet P, cause the first CIS 35 and the second CIS 36, both of which function as a detector to detect time changes at each of the multiple angles at the lateral end face Pa of the sheet P while the pair of sheet holding rollers 31 and the pair of downstream side sheet conveying rollers 103 that functions as a second pair of rollers are conveying the sheet P, and determine a home position corresponding to a position where a rate of the time change after the sheet P has reached the first nip region of the pair of sheet holding rollers 31 is substantially identical to a rate of the time change after the sheet P has reached the second nip region of the pair of downstream side sheet conveying rollers 103.

According to this configuration, the sheet conveying device 30 performs the correction of angular displacement of the sheet P being conveyed in the predetermined sheet conveying direction with high accuracy.

It is to be noted that, similar to Embodiment 1, this disclosure is applicable to the various configurations of Embodiment 2.

Embodiment 3

Figure 19:
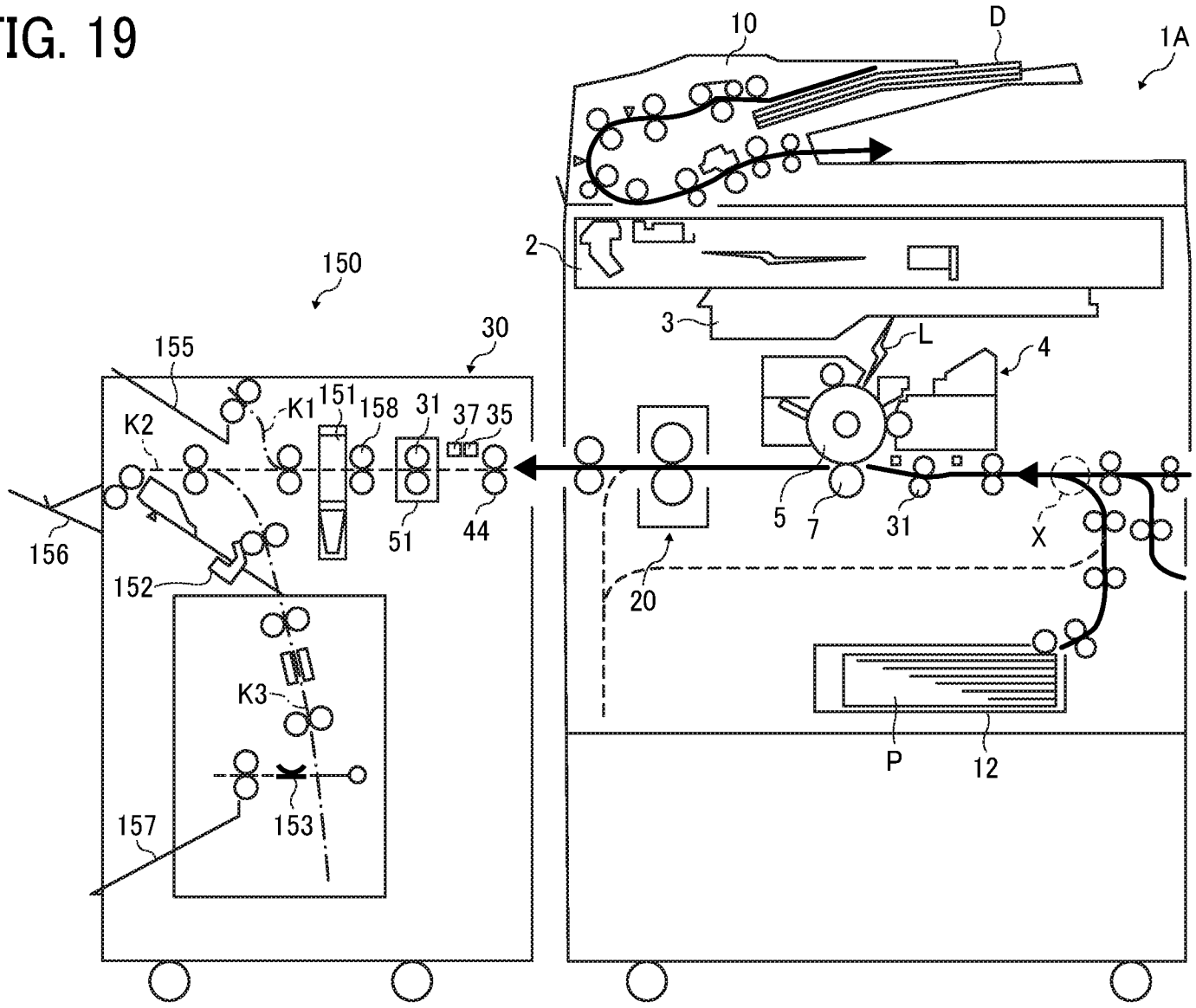
FIG. 19 is a diagram illustrating an overall configuration of an image forming apparatus according to Embodiment 3 of this disclosure.

Next, a description is given of a configuration and functions of the sheet conveying device 30 and an image forming apparatus 1A, according to Embodiment 3 of this disclosure, with reference to FIG. 19.

FIG. 19 is a diagram illustrating an overall configuration of the image forming apparatus 1A according to Embodiment 3 of this disclosure. The configuration and functions of the image forming apparatus 1A according to Embodiment 3 is basically identical to the configuration and functions of the image forming apparatus 1 according to Embodiment 1 and the image forming apparatus 100 according to Embodiment 2, except that the image forming apparatus 1A of Embodiment 3 includes a post processing device 150 that performs post processing operations such as punching, sheet binding and sheet folding, to the sheet P after completion of image formation.

The post processing device 150 illustrated in FIG. 19 is detachably attached to the apparatus body of the image forming apparatus 1A and includes a punching device 151, a binding device 152, a sheet folding device 153 and multiple trays (sheet stackers). The punching device 151 performs a punching process to punch or open holes on a sheet P. The binding device 152 performs a stapling process and a binding process of a sheet P. The sheet folding device 153 performs a folding process of a sheet P after image formation. The multiple trays (sheet stackers) of the post processing device 150 according to Embodiment 3 are a first discharging tray 155, a second sheet discharging tray 156 and a third sheet discharging tray 157. The post processing device 150 further includes a pair of downstream side sheet conveying rollers 158 that functions as a second pair of rollers to convey the sheet P together with the pair of sheet holding rollers 31.

Similar to the image forming apparatus 1 according to Embodiment 1 and the image forming apparatus 100 according to Embodiment 2, the post processing device 150 according to Embodiment 3 includes the sheet conveying device 30.

It is to be noted that the post processing device 150 further includes a first sheet conveyance passage K1, a second sheet conveyance passage K3 and a third sheet conveying passage K3. The first sheet conveyance passage K1 is a sheet conveyance passage to convey a sheet P to which the punching process is performed in the punching device 151 or a sheet P to which no post processing process is performed, to the first discharging tray 155.

The second sheet conveyance passage K2 is a sheet conveyance passage to convey a sheet P toward the binding device 152 and a bundle of sheets P after completion of the stapling process and/or the binding process to the second sheet discharging tray 156.

The third sheet conveyance passage K3 is a sheet conveyance passage to convey a sheet P toward the sheet folding device 153 and the sheet P after completion of the center folding process to the third sheet discharging tray 157.

Now, a description is given of regular image forming operations performed by the post processing device 150, with reference to FIG. 19.

First, after having been discharged from the apparatus body of the image forming apparatus 1A, the sheet P is convened into the post processing device 150. Then, similar to Embodiments 1 and 2, in the sheet conveying device 30 of Embodiment 3, the pair of sheet holding rollers 31 performs the corrections of angular and lateral displacements of the sheet P based on the detection results of the two CISs, which are the first CIS 35 and the second CIS 36. After the corrections of angular and lateral displacement, the sheet P is conveyed to any one of the first sheet conveying passage K1, the second sheet conveying passage K2 and the third sheet conveying passage K3 according to a post processing operation instructed by a user. After the corresponding post processing operation has been performed to the sheet P, the sheet P is discharged to any one of the first discharging tray 155, the second sheet discharging tray 156 and the third sheet discharging tray 157.

As described above, similar to the sheet conveying device 30 according to Embodiments 1 and 2, the sheet conveying device 30 of the post processing device 150 according to Embodiment 3 includes the controller 90 to cause the second drive device to rotate the pair of sheet holding rollers 31 that functions as a first pair of rollers to multiple angles in the direction parallel to the plane of the sheet P, cause the first CIS 35 and the second CIS 36, both of which function as a detector to detect time changes at each of the multiple angles at the lateral end face Pa of the sheet P while the pair of sheet holding rollers 31 and the pair of downstream side sheet conveying rollers 158 that functions as a second pair of rollers are conveying the sheet P, and determine a home position corresponding to a position where a rate of the time change after the sheet P has reached the first nip region of the pair of sheet holding rollers 31 is substantially identical to a rate of the time change after the sheet P has reached the second nip region of the pair of downstream side sheet conveying rollers 158. According to this configuration, the sheet conveying device 30 performs the correction of angular displacement of the sheet P being conveyed in the predetermined sheet conveying direction with high accuracy.

Specifically, the post processing device 150 in Embodiment 3 can reduce the amount of angular and lateral displacement of the sheet P and provide the post processing operations with high accuracy.

It is to be noted that, similar to Embodiments 1 and 2, this disclosure is applicable to the various configurations of Embodiment 3.

Further, in the above-described Embodiments 1, 2 and 3, the sheet conveying device 30 is provided to the electrophotographic image forming apparatus 1, the inkjet image forming apparatus 100 and the post processing device 150. However, the sheet conveying device 30 is not limited thereto and may be provided to any other type of image forming apparatuses such as an offset printing machine as long as the sheet conveying device 30 performs the correction of angular displacement of the sheet P and the correction of lateral displacement of the sheet P.

Further, even in the above-described case, the above-described configuration can achieve the same effect as each configuration of the sheet conveying device 30 according to Embodiments 1, 2 and 3.

Further, in the above-described Embodiments 1, 2 and 3, the first drive device has the configuration in which the first cam 84 presses the holding member 72 (that is, the projection 72*a*) indirectly via the lever 81. However, the configuration of the first drive device is not limited thereto but may be a configuration in which the first cam 84 presses the holding member 72 directly.

Further, in the above-described Embodiments 1, 2 and 3, the second drive device has the configuration in which the second cam 74 presses the holding member 72 (that is, the support shaft 73) directly. However, the configuration of the second drive device is not limited thereto but may be a configuration in which the second cam 74 presses the holding member 72 indirectly.

Further, in the above-described Embodiments 1, 2 and 3, a cam mechanism is employed for the second drive device and the third drive device. However, the configurations of the second drive device and the third drive device are not limited thereto. For example, the second drive device and the third drive device may employ a solenoid mechanism or a rack and pinion mechanism.

Further, the above-described configurations can achieve the same effect as each configuration of the sheet conveying device 30 according to Embodiments 1, 2 and 3.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set.

It is to be noted that, as described above, a "sheet" in the above-described embodiments of this disclosure is not limited to indicate a (regular) paper but also includes any other sheet-like material such as coated paper, label paper, OHP film sheet, film, metal sheet, prepreg, and the like.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a detector configured to detect a position of a lateral end face of at least two sheets conveyed in a sheet conveyance passage;

a first drive device;

a second drive device;

a first pair of rollers forming a first nip region, the first pair of rollers configured to convey a corresponding one of the at least two sheets in response to driving power from the first drive device;

a second pair of rollers forming a second nip region and disposed either one of an upstream side and a downstream side of the sheet conveyance passage in a sheet conveying direction from the first pair of rollers; and a controller configured to perform a home position adjustment operation during conveyance of each of the at least two sheets to determine a home position of the sheet conveyance device by, causing the second drive device to rotate the first pair of rollers to a different one of multiple angles in a direction parallel to a plane of the corresponding one of the at least two sheets such that, for a first sheet of the at least two sheets, the first pair of rollers is set at a first angle in the direction parallel to a plane of the first sheet and for a second sheet of the at least two sheets, the first pair of rollers is set to a second angle in the direction parallel to a plane of the second sheet, the first angle being different than the second angle, causing the detector to detect time change at a corresponding one of the multiple angles at the lateral end face of the corresponding one of the at least two sheets while conveying the corresponding one of the at least two sheets by the first pair of rollers and the second pair of rollers, and determining which one of the multiple angles is a position of the first pair of rollers where a rate of the time change after the corresponding one of the at least two sheets has reached the first nip region of the first pair of rollers is substantially identical to a rate of the time change after the corresponding one of the at least two sheets has reached the second nip region of the second pair of rollers.

2. The sheet conveying device according to claim 1, further comprising:

a pair of upstream side sheet conveying rollers upstream from the first pair of rollers in the sheet conveying direction, wherein the second pair of rollers includes a pair of downstream side sheet conveying rollers, and the controller is configured to, cause the second drive device to rotate the first pair of rollers to the corresponding one of multiple angles in the direction parallel to the plane of the corresponding one of the at least two sheets, cause the detector to detect the time change before the corresponding one of the at least two sheets has reached the first pair of rollers until the corresponding one of the at least two sheets is conveyed to the first pair of rollers by the pair of downstream side sheet conveying rollers, at the corresponding one of the multiple angles at the lateral end face of the corresponding one of the at least two sheets while conveying the corresponding one of the at least two sheets by at least the first pair of rollers and the pair of downstream side sheet conveying rollers out of the pair of upstream side sheet conveying rollers, the first pair of rollers and the pair of downstream side sheet conveying rollers, and determine the home position based on the rate of the time change after the corresponding one of the at least two sheets has reached the first nip region of the first pair of rollers and the rate of the time change after the corresponding one of the at least two sheets has reached the second nip region of the second pair of rollers.

3. The sheet conveying device according to claim 1, further comprising:

a second detector configured to detect an amount of angular displacement in the direction parallel to the plane of the corresponding one of the at least two sheets conveyed in the sheet conveyance passage, wherein the controller is configured to:

cause the second drive device to rotate the first pair of rollers from the home position to a position facing the corresponding one of the at least two sheets corresponding to the amount of angular displacement of the corresponding one of the at least two sheets based on a detection result of the second detector before the corresponding one of the at least two sheets has been conveyed to the first pair of rollers, and cause the second drive device to rotate the first pair of rollers by an amount same as the amount of angular displacement of the corresponding one of the at least two sheets, to the home position while the first pair of rollers is holding the corresponding one of the at least two sheets.

4. The sheet conveying device according to claim 3, wherein the detector includes the second detector.

5. The sheet conveying device according to claim 4, wherein the home position includes a first home position and a second home position such that, during a position correction operation, the first pair of rollers rotates angular to return to the first home position and moves laterally to return to the first home position after rotating and gripping a third sheet to perform the position correction operation, and the sheet conveying device further comprises:

a third drive device configured to cause the first pair of rollers to move from the second home position in a width direction based on the detection result of the detector, wherein the controller is configured to, cause the third drive device to move the first pair of rollers in the width direction from the second home position corresponding to an amount of lateral displacement of the corresponding one of the at least two sheets based on the detection result of the detector before the corresponding one of the at least two sheets has been conveyed to the first pair of rollers, and cause the third drive device to move the first pair of rollers by an amount same as the amount of lateral displacement of the corresponding one of the at least two sheets, to the second home position while the first pair of rollers is holding the corresponding one of the at least two sheets.

6. The sheet conveying device according to claim 3, wherein the home position includes a first home position and a second home position such that, during a position correction operation, the first pair of rollers rotates angular to return to the first home position and moves laterally to return to the first home position after rotating and gripping a third sheet to perform the position correction operation, and the sheet conveying device further comprises:

a third drive device configured to cause the first pair of rollers to move from the second home position in a width direction based on the detection result of the detector, wherein the controller is configured to, cause the third drive device to move the first pair of rollers in the width direction from the second home position corresponding to an amount of lateral displacement of the corresponding one of the at least two sheets based on the detection result of the detector before the corresponding one of the at least two sheets has been conveyed to the first pair of rollers, and cause the third drive device to move the first pair of rollers by an amount same as the amount of lateral displacement of the corresponding one of the at least two sheets, to the second home position while the first pair of rollers is holding the corresponding one of the at least two sheets.

7. The sheet conveying device according to claim 1, wherein the detector includes two contact image sensors disposed upstream from the first pair of rollers and spaced apart in the sheet conveying direction, and the controller is configured to:

cause the second drive device to rotate the first pair of rollers to multiple angles in the direction parallel to the plane of the corresponding one of the at least two sheets, cause the two contact image sensors to detect respective time changes of the time change before the corresponding one of the at least two sheets has reached the first pair of rollers at the corresponding one of the multiple angles at the lateral end face of the corresponding one of the at least two sheets while conveying the corresponding one of the at least two sheets by the first pair of rollers and the second pair of rollers, and determine the home position based on the rate of the time change after the corresponding one of the at least two sheets has reached the first nip region of the first pair of rollers and the rate of the time change after the corresponding one of the at least two sheets has reached the second nip region of the second pair of rollers, based on detection results of the two contact image sensors.

8. The sheet conveying device according to claim 1, wherein the controller is configured to set the one of the multiple angles as the home position of the sheet conveying device, such that, during a position correction operation subsequent to the home position adjustment operation, the first pair of rollers returns to the home position after rotating and gripping one of the at least two sheets to perform the position correction operation.

9. An image forming apparatus comprising:

the sheet conveying device according to claim 1.

10. The sheet conveying device according to claim 1, wherein the controller performs the home position adjustment operation by separately conveying the first sheet at the first angle and the second sheet at the second angle, and detecting the time change during conveyance of each of the first sheet and the second sheet, and the rate of time change indicates a rate of change of the position of the respective one of the first sheet or the second sheet relative to time.

11. A sheet conveying device comprising:

a detector configured to detect a position of a lateral end face of at least two sheets conveyed in a sheet conveyance passage;

a first drive device;

a second drive device;

a first pair of rollers forming a first nip region, the first pair of rollers configured to convey a corresponding one of the at least two sheets in response to driving power from the first drive device;

a second pair of rollers forming a second nip region and disposed either one of an upstream side and a downstream side of the sheet conveyance passage in a sheet conveying direction from the first pair of rollers; and a controller configured to perform a home position adjustment operation during conveyance of each of the at least two sheets to adjust a home position of the sheet conveying device by, causing the second drive device to rotate the first pair of rollers to a different one of multiple angles in a direction parallel to a plane of the corresponding one of the at least two sheets such that, for a first sheet of the at least two sheets, the first pair of rollers is set at a first angle in the direction parallel to a plane of the first sheet and for a second sheet of the at least two sheets, the first pair of rollers is set to a second angle in the direction parallel to a plane of the second sheet, the first angle being different than the second angle, causing the detector to detect time change at the corresponding one of the multiple angles at the lateral end face of the corresponding one of the at least two sheets while conveying the corresponding one of the at least two sheets by the first pair of rollers and the second pair of rollers, and determining which one of the multiple angles is a position of the first pair of rollers having a least difference between a rate of the time change after the corresponding one of the at least two sheets has reached the first nip region of the first pair of rollers and a rate of the time change after the corresponding one of the at least two sheets has reached the second nip region of the second pair of rollers.

12. The sheet conveying device according to claim 11, further comprising:

a pair of upstream side sheet conveying rollers upstream from the first pair of rollers in the sheet conveying direction, wherein the second pair of rollers includes a pair of downstream side sheet conveying rollers, and the controller is configured to, cause the second drive device to rotate the first pair of rollers to multiple angles in the direction parallel to the plane of the corresponding one of the at least two sheets, cause the detector to detect the time change before the corresponding one of the at least two sheets has reached the first pair of rollers until the corresponding one of the at least two sheets is conveyed to the first pair of rollers by the pair of downstream side sheet conveying rollers, at the corresponding one of the multiple angles at the lateral end face of the corresponding one of the at least two sheets while conveying the corresponding one of the at least two sheets by at least the first pair of rollers and the pair of downstream side sheet conveying rollers out of the pair of upstream side sheet conveying rollers, the first pair of rollers and the pair of downstream side sheet conveying rollers, and determine the home position based on the rate of the time change after the corresponding one of the at least two sheets has reached the first nip region of the first pair of rollers and the rate of the time change after the corresponding one of the at least two sheets has reached the second nip region of the second pair of rollers.

13. The sheet conveying device according to claim 11, further comprising:

a second detector configured to detect an amount of angular displacement in the direction parallel to the plane of the corresponding one of the at least two sheets conveyed in the sheet conveyance passage, wherein the controller is configured to:

cause the second drive device to rotate the first pair of rollers from the home position to a position facing the corresponding one of the at least two sheets corresponding to the amount of angular displacement of the corresponding one of the at least two sheets based on a detection result of the second detector before the corresponding one of the at least two sheets has been conveyed to the first pair of rollers, and cause the second drive device to rotate the first pair of rollers by an amount same as the amount of angular displacement of the corresponding one of the at least two sheets, to the home position while the first pair of rollers is holding the corresponding one of the at least two sheets.

14. The sheet conveying device according to claim 13, wherein the detector includes the second detector.

15. The sheet conveying device according to claim 14, wherein the home position includes a first home position and a second home position such that, during a position correction operation, the first pair of rollers rotates angular to return to the first home position and moves laterally to return to the first home position after rotating and gripping a third sheet to perform the position correction operation, and the sheet conveying device further comprises:

a third drive device configured to cause the first pair of rollers to move from the second home position in a width direction based on the detection result of the detector, wherein the controller is configured to:

cause the third drive device to move the first pair of rollers in the width direction from the second home position corresponding to an amount of lateral displacement of the corresponding one of the at least two sheets based on the detection result of the detector before the corresponding one of the at least two sheets has been conveyed to the first pair of rollers, and cause the third drive device to move the first pair of rollers by an amount same as the amount of lateral displacement of the corresponding one of the at least two sheets, to the second home position while the first pair of rollers is holding the corresponding one of the at least two sheets.

16. The sheet conveying device according to claim 13, wherein the home position includes a first home position and a second home position such that, during a position correction operation, the first pair of rollers rotates angular to return to the first home position and moves laterally to return to the first home position after rotating and gripping a third sheet to perform the position correction operation, and the sheet conveying device further comprises:

a third drive device configured to cause the first pair of rollers to move from the second home position in a width direction based on the detection result of the detector, wherein the controller is configured to, cause the third drive device to move the first pair of rollers in the width direction from the second home position corresponding to an amount of lateral displacement of the corresponding one of the at least two sheets based on the detection result of the detector before the corresponding one of the at least two sheets has been conveyed to the first pair of rollers, and cause the third drive device to move the first pair of rollers by an amount same as the amount of lateral displacement of the corresponding one of the at least two sheets, to the second home position while the first pair of rollers is holding the corresponding one of the at least two sheets.

17. The sheet conveying device according to claim 11, wherein the detector includes two contact image sensors disposed upstream from the first pair of rollers and spaced apart in the sheet conveying direction, and the controller is configured to, cause the second drive device to rotate the first pair of rollers to multiple angles in the direction parallel to the plane of the corresponding one of the at least two sheets, cause the two contact image sensors to detect respective time changes of the time change before the corresponding one of the at least two sheets has reached the first pair of rollers at the corresponding one of the multiple angles at the lateral end face of the corresponding one of the at least two sheets while conveying the corresponding one of the at least two sheets by the first pair of rollers and the second pair of rollers, and determine the home position based on the rate of the time change after the corresponding one of the at least two sheets has reached the first nip region of the first pair of rollers and the rate of the time change after the corresponding one of the at least two sheets has reached the second nip region of the second pair of rollers, based on detection results of the two contact image sensors.

18. The sheet conveying device according to claim 11, wherein the controller is configured to set the one of the multiple angles as the home position of the sheet conveying device, such that, during a position correction operation subsequent to the home position adjustment operation, the first pair of rollers returns to the home position after rotating and gripping one of the at least two sheets to perform the position correction operation.

19. An image forming apparatus comprising:

the sheet conveying device according to claim 11.

20. A sheet conveying device comprising:

a detector configured to detect a position of a lateral end face of at least two sheets conveyed in a sheet conveyance passage;

a first drive device;

a second drive device;

a first pair of rollers forming a first nip region, the first pair of rollers configured to convey a corresponding one of the at least two sheets in response to driving power from the first drive device;

a second pair of rollers forming a second nip region and disposed either one of an upstream side and a downstream side of the sheet conveyance passage in a sheet conveying direction from the first pair of rollers; and a controller configured to perform a home position adjustment operation to adjust a home position of the sheet conveying device by, causing the second drive device to rotate the first pair of rollers to a first angle in a direction parallel to a plane of a first sheet of the at least two sheets, causing the detector to detect time change at the first angle at the lateral end face of the first sheet while conveying the first sheet by the first pair of rollers and the second pair of rollers, causing the second drive device to rotate the first pair of rollers to a second angle in a direction parallel to a plane of a second sheet of the at least two sheets, causing the detector to detect time change at the second angle at the lateral end face of the second sheet while conveying the second sheet by the first pair of rollers and the second pair of rollers, and determining which one of the first angle and the second angle is a position of the first pair of rollers where a rate of the time change after one of the at least two sheets has reached the first nip region of the first pair of rollers is substantially identical to a rate of the time change after the one of the at least two sheets has reached the second nip region of the second pair of rollers.

21. The sheet conveyance device of claim 20, wherein the controller is further configured to set the one of the first angle and the second angle as the home position of the sheet conveying device, such that, during a position correction operation subsequent to the home position adjustment operation, the first pair of rollers returns to the home position after rotating and gripping one of the at least two sheets to perform the position correction operation.

* * * * *